US006794121B2

(12) United States Patent
Foster et al.

(10) Patent No.: US 6,794,121 B2
(45) Date of Patent: Sep. 21, 2004

(54) METHOD OF MAKING A SILVER HALIDE PHOTOGRAPHIC MATERIAL HAVING ENHANCED LIGHT ABSORPTION AND LOW FOG AND CONTAINING A SCAVENGER FOR OXIDIZED DEVELOPER

(75) Inventors: David R. Foster, Rochester, NY (US); Stephen P. Singer, Spencerport, NY (US); William J. Harrison, Pittsford, NY (US); Alan R. Pitt, Sandridge (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/346,961

(22) Filed: Jan. 17, 2003

(65) Prior Publication Data

US 2004/0142290 A1 Jul. 22, 2004

(51) Int. Cl.[7] ..... G03C 5/18; G03C 5/26; G03C 1/005; G03C 1/494

(52) U.S. Cl. ..... 430/449; 430/570; 430/572; 430/574; 430/576; 430/577; 430/580; 430/581; 430/583; 430/584; 430/585

(58) Field of Search ..... 430/449, 570, 430/572, 574, 576, 577, 580–581, 583–585

(56) References Cited

U.S. PATENT DOCUMENTS

| | | | | |
|---|---|---|---|---|
| 3,622,316 | A | 11/1971 | Bird et al. | |
| 6,048,681 | A | 4/2000 | Suzumoto et al. | |
| 6,117,629 | A | 9/2000 | Yamashita et al. | |
| 6,143,486 | A | 11/2000 | Parton et al. | |
| 6,165,703 | A | 12/2000 | Parton et al. | |
| 6,312,883 | B1 | 11/2001 | Parton et al. | |
| 6,319,660 | B1 | 11/2001 | Allway et al. | |
| 6,329,133 | B1 | 12/2001 | Andrievsky et al. | |
| 6,331,385 | B1 | 12/2001 | Deaton et al. | |
| 6,361,932 | B1 | 3/2002 | Parton et al. | |
| 6,558,893 | B1 * | 5/2003 | Parton et al. | 430/574 |
| 6,620,581 | B1 * | 9/2003 | Parton et al. | 430/570 |

FOREIGN PATENT DOCUMENTS

| | | |
|---|---|---|
| EP | 1 061 411 A1 | 12/2000 |
| EP | 0 838 719 B1 | 2/2003 |
| JP | 10/171058 | 6/1998 |

OTHER PUBLICATIONS

Thomas L. Penner et al, *Photographic Science and Engineering*, "Spectral Shifts and Physical Layering of Sensitizing Dye Combinations in Silver Halide Emulsions", vol. 20, 1976, pp. 97–106.

Thomas L. Penner, *Photographic Science and Engineering*, "Electrophoresis of Spectral Sensitizing Dyes on Silver Halide: Evidence for Dye Layering", vol. 21, 1977, pp. 32–36.

IP.com publication 000006637D published Jan. 17, 2002, pp. 1–51.

U.S. application Ser. No. 10/346,745 filed Jan. 17, 2003 "A Method of Making a Silver Halide Photographic Material Having Enhanced Light Absorption and Low Fog" of David R. Foster et al.

U.S. application Ser. No. 10/347,014 filed Jan. 17, 2003 "Silver Halide Material Comprising Low Stain Antenna Dyes" of Richard L. Parton et al.

* cited by examiner

*Primary Examiner*—Geraldine Letscher
(74) *Attorney, Agent, or Firm*—Sarah Meeks Roberts

(57) ABSTRACT

This invention relates to a method of spectrally sensitizing a silver halide emulsion comprising the following steps in the following order a) providing a silver halide emulsion comprising tabular silver halide grains having an inner dye layer adjacent to the silver halide grain, said dye layer comprising at least one dye (Dye 1) that is capable of spectrally sensitizing silver halide, b) adding to the emulsion at least one dye (Dye 2) capable of providing a second dye layer adjacent to the inner dye layer, and c) adding to the emulsion a non-cationic surfactant or a scavenger for oxidized developer, or a combination of the two, to form a silver halide emulsion comprising silver halide grains having associated therewith two dye layers, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer.

31 Claims, 1 Drawing Sheet

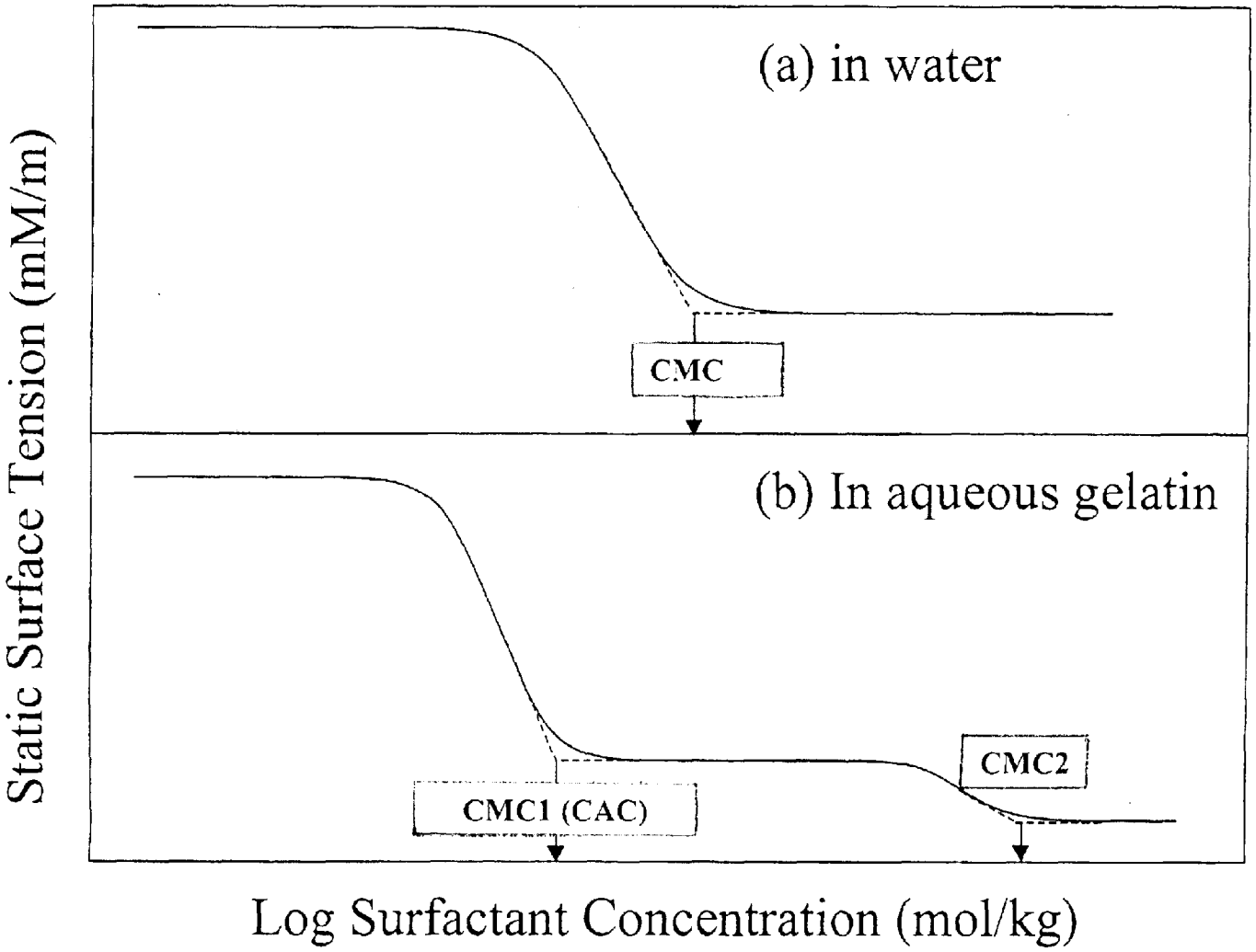
(a) in water
CMC
(b) In aqueous gelatin
CMC2
CMC1 (CAC)
Log Surfactant Concentration (mol/kg)
Static Surface Tension (mM/m)

METHOD OF MAKING A SILVER HALIDE PHOTOGRAPHIC MATERIAL HAVING ENHANCED LIGHT ABSORPTION AND LOW FOG AND CONTAINING A SCAVENGER FOR OXIDIZED DEVELOPER

FIELD OF THE INVENTION

This invention relates to a method of making a silver halide photographic material containing at least one silver halide emulsion that has enhanced light absorption. The invention is directed in particular to a method of making an emulsion with high sensitivity, reduced fog and granularity.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to the increased surface area per mole of silver. However, in most photographic systems, it is still the case that not all of the available light is being collected.

The need is especially great in the blue spectral region where a combination of low source intensity and relatively low dye extinction results in a deficient photoresponse. The need for increased light absorption is also great in the green sensitization of the magenta record of multilayer color film photographic elements. The eye is most sensitive to the magenta image dye and this layer has the largest impact on color reproduction. Higher speed in this layer can be used to obtain improved color and image quality characteristics. The cyan layer could also benefit from increased red-light absorption that could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.*, 18, 562 (1974)). One method is to synthesize molecules in which two dye chromophores are covalently connected by a linking group (see U.S. Pat. Nos. 2,518,731, 3,976,493, 3,976,640, 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not covalently linked to one another. In this approach the dyes can be added sequentially and are less likely to interfere with each other. Miyasaka et al. in EP 270 079 and EP 270 082 describe silver halide photographic material having an emulsion spectrally sensitized with an adsorbable sensitizing dye used in combination with a non-adsorbable luminescent dye that is located in the gelatin phase of the element. Steiger et al. in U.S. Pat. Nos. 4,040,825 and 4,138,551 describe a silver halide photographic material having an emulsion spectrally sensitized with an adsorbable sensitizing dye used in combination with a second dye that is bonded to gelatin. The problem with these approaches is that unless the dye that is not adsorbed to the grain is in close proximity to the dye adsorbed on the grain (less than 50 angstroms separation) efficient energy transfer will not occur (see T. Förster, *Disc. Faraday Soc.*, 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.*, 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.*, 20, 97 (1976); see also Penner, *Photogr. Sci. Eng.*, 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. A problem with previous dye layering approaches was that the dye layers described produced a very broad sensitization envelope. This may be desirable for some black and white photographic applications, but in a multilayer color film element this would lead to poor color reproduction since, for example, the silver halide grains in the same color record would be sensitive to both green and red light.

Yamashita et al. (EP 838 719 A2, U.S. Pat. No. 6,117,629) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et al. teaches that dye layering will not occur if this requirement is not met. This is undesirable because such substitutents can lead to large amounts of retained dye after processing (dye stain) that affords increased D-min. Similar results are described in U.S. Pat. No. 6,048,681 and EP 1,061,431A1. EP 1,061,411 A1 describes forming dye layers by using dyes with additional polycyclic rings. The dyes have at least one heterocyclic ring that has two or more additional rings attached to it. This may promote dye-dye interactions by increasing van der Waals forces, however, adding hydrophobic, aromatic rings to the dye molecules is undesirable in that the dyes are more likely to be retained after processing and give higher dye stain. Yamashita and Kobayashi (JP 10/171058) describe silver halide photographic emulsions that contain an anionic dye and a cationic dye, where the charge of either the anionic dye or the cationic dye is 2 or greater. Tadashi and Takashi describe (JP2001013614A) combinations of cyanine dyes wherein the logP for the dye combination is in a certain preferred range.

Further improvements in dye layering have been described in U.S. Pat. Nos. 6,143,486, 6,165,703, 6,329,133, 6,331,385, and 6,361,932. Useful antenna dyes (dyes in the outer layer of the multilayer) for dye layering that have less dye stain after processing were described in U.S. Pat. No. 6,312,883.

It also known in the art to add a scavenger for oxidized developer to a photographic element in order to prevent oxidized developing agent from reacting within the element at an undesired location or at an undesired point in time. In particular, it is undesirable for oxidized developer to diffuse away from the imaging layer in which it formed and into other color records where it can form dye in the wrong layer. Thus, scavengers for oxidized developer are typically located in non-image forming interlayers between two imaging layers. However, in some situations early formation of dye can have an undesirable impact on tone scale and fog formation. Thus, it is also known to add scavengers for oxidized developers directly to imaging layers in order to modulate Dox levels.

Typically, scavengers reduce or eliminate oxidized developers without forming any permanent dyes. They also do not cause stains nor release fragments that have photographic activity. They are also typically rendered substantially immobile in the element by incorporation of an anti-diffusion group (a ballast) or by attachment to a polymer backbone.

Known scavengers for oxidized developers include ballasted para hydroquinone (1,4-dihydroxybenzene) compounds such as described in U.S. Pat. Nos. 3,700,453, 4,732,845, 5,561,036, 6,045,988 and 5,585,230; ballasted gallic acid (1,2,3-trihydroxybenzene) compounds as described in U.S. Pat. Nos. 4,474,874 and 4,476,219; ballasted resorcinol (1,3-dihydroxybenzene) compounds as described in U.S. Pat. Nos. 3,770,431, 5,856,072 and 3,772,014; ballasted hydrazides such as described in U.S. Pat. Nos. 4,923,787, 4,971,890, 5,147,764, 5,164,288, 5,230,992, 5,629140 and 5,543,277; ballasted pyrocatechol (1,2-dihydroxybenzene) compounds as described in U.S. Pat. Nos. 4,175,968, 5,561,036, 4,252,893, 5,561,035 and DE766,135; couplers which do not form permanent dyes such as those described in U.S. Pat. Nos. 5,932,407, 5,629,140, EP 0284099 and U.S. Pat. No. 6,013,428; and disulfonamidophenyl scavengers as described in U.S. Pat. Nos. 4,447,523, 4,205,987, 4,717,651, 5,478,712 and 6,255,045.

It is known that water-solubilizing groups may be used to increase the reactivity towards Dox in many of these classes of scavengers. Addition of water-solubilizing groups to ballasted compounds tend to impart surfactant-like properties to the material. However, for the types of emulsions and formats used in the above references, the additional surfactant-like properties of ballasted scavengers with water solubilizing groups do not confer any additional advantages or utility.

It is also know in the art to utilize various surfactants in photographic elements for many different reasons including, for example, surface-tension control to prevent stacked liquid layers from mixing during multiplayer coating processes. The art in this area is voluminous, but is generally discussed in *Research Disclosure*, September 1996, Item 38957.

Dye-layered silver halide emulsions using cationic antenna sensitizing dyes provide enhanced light absorption and photographic sensitivity (speed) in photographic elements. However, as currently practiced, these materials often produce concomitant unacceptable increases in silver fog and associated granularity which may limit their practical utility. This problem is often exacerbated with the use of smaller emulsions and especially so with emulsion sizes of 1 micron (equivalent circular diameter), or less. Silver halide antifoggants such as N-(3-(2,5-dihydro-5-thioxo-1H-tetrazole-1-yl)phenyl)-Acetamide (APMT) and 5-methyl-(1,2,4)Triazolo(1,5-a)pyrimidin-7-ol, sodium salt (TAI) have been disclosed for use with dye-layered emulsions, but are insufficient to completely reduce the D-min. Increasing amounts of APMT reduce the fog, but cause unacceptable loss of emulsion sensitivity. Other common antifoggants and stabilizers were found to be ineffective for minimizing silver fog and its associated granularity signal without large speed loss. It remains a problem to achieve both high sensitivity and low fog in a dye-layered emulsion.

SUMMARY OF THE INVENTION

In one embodiment this invention provides a method of spectrally sensitizing a silver halide emulsion comprising the following steps in the following order a) providing a silver halide emulsion comprising tabular silver halide grains having an inner dye layer adjacent to the silver halide grain, said dye layer comprising at least one dye (Dye 1) that is capable of spectrally sensitizing silver halide, b) adding to the emulsion at least one dye (Dye 2) capable of providing a second dye layer adjacent to the inner dye layer, and c) adding to the emulsion a non-cationic surfactant, to form a silver halide emulsion comprising silver halide grains having associated therewith two dye layers, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer.

In another embodiment this invention provides a method of spectrally sensitizing a silver halide emulsion comprising the following steps in the following order a) providing a silver halide emulsion comprising tabular silver halide grains having an inner dye layer adjacent to the silver halide grain, said dye layer comprising at least one dye (Dye 1) that is capable of spectrally sensitizing silver halide, b) adding to the emulsion at least one dye (Dye 2) capable of providing a second dye layer adjacent to the inner dye layer, and c) adding to the emulsion a scavenger for oxidized developer, to form a silver halide emulsion comprising silver halide grains having associated therewith two dye layers, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer.

In a preferred embodiment both a scavenger for oxidized developer and a surfactant are added during step c). Silver halide photographic elements containing emulsions made as described herein exhibit both high sensitivity and low fog. Such elements also exhibit reduced granularity.

DESCRIPTION OF THE DRAWING

The FIGURE depicts a schematic representation of static surface tension versus log (concentration) for a typical anionic surfactant.

DETAILED DESCRIPTION OF THE INVENTION

According to this invention the emulsion must be prepared in the following manner. A silver halide emulsion comprising tabular silver halide grains having an inner dye layer adjacent to the silver halide grain, said dye layer comprising at least one dye (Dye 1) that is capable of spectrally sensitizing silver halide is prepared. At least one dye (Dye 2) which is capable of providing a second dye layer adjacent to the inner dye layer is added to the emulsion. After Dye 2 has been added, a non-cationic surfactant or a scavenger for oxidized developer, or a combination of both, is added to the emulsion.

The dye layered emulsion formed by the above process comprises (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation—π interactions, etc. or by in situ bond formation. The inner dye layer(s) is absorbed to the silver halide grains and contains at least one spectral sensitizer. The outer dye layer(s) (also referred to as an antenna dye) absorbs light at an equal or higher energy (equal or shorter wavelength) than the adjacent inner dye layer(s). The light energy emission wavelength of the outer dye layer overlaps with the light energy absorption wavelength of the adjacent inner dye layer.

Dye 1 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferably Dye 1 is a cyanine dye.

In one preferred embodiment Dye 1 comprises at least one anionic substiutent. Examples of anionic substituents are alkyl groups containing acid salts. Acid salt are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to: 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, methanesulfonylcarbamoylmethyl, and the like.

Dye 2 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferably Dye 2 is not a cyanine dye. Most preferably Dye 2 is a merocyanine dye. A merocyanine dye has one basic nucleus and one acidic nucleus separated by a conjugated chain having an even number of methine carbons (see *The Theory of the Photographic Process*, $4^{th}$ edition, T. H. James, editor, Macmillan Publishing Co., New York, 1977 for an explanation of basic and acidic nuclei).

Dye 2 preferably has at least one cationic substitutent. The term "cationic substituent" includes a substituent which can be protonated to become a cationic substituent. Examples of positively charged substituents are 3-(trimethylammonio) propyl), 3-(4-ammoniobutyl), 3-(4guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethyl aminopropyl), 4-(4-methylaminopropyl), etc. In a preferred embodiment of the invention Dye 1 comprises at least one anionic substituent, and Dye 2 comprises at least one cationic substituent.

Specific spectral sensitizing dyes (Dye 1) and antenna dyes (Dye 2) useful in the invention and methods of dye layering are described in detail in Parton, et al. European patent application publications EP 985,967, corresponding to U.S. Pat. No. 6,361,932, and EP 1,199,595, corresponding to U.S. application Ser. No. 09/690,068 filed Oct. 16, 2000, U.S. Pat. Nos. 6,143,486, 6,165,703, 6,312,883, Deaton, et al., U.S. Pat. No. 6,331,385 and Andrievsky, et al., U.S. Pat. No. 6,329,133, the entire contents of which are herein incorporated by reference. The dyes of the commonly-assigned and co-filed US patent application of Parton, et al., SILVER HALIDE MATERIAL COMPRISING LOW STAIN ANTENNA DYES, is also incorporated herein by reference. Dye 1 and Dye 2 are also described in detail in "Technology Useful in Combination with Antenna Dyes", IP.com, Publication 000006637D, (IPCOM000006637D), published Jan. 17, 2002, pp. 1–51. Also discussed in the above references are methods to determine if dye layering has occurred, said discussion also incorporated by reference.

In a preferred embodiment the emulsion is chemically sensitized and heat treated after the addition of Dye 1 and prior to the addition of Dye 2. The chemical sensitization methods utilized in preparing the emulsions employed in the invention can be any of those methods known in the art. Chemical sensitization of the emulsion typically employs adding sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides, and providing a heating step during which the emulsion temperature is raised, typically from 40° C. to 70° C., and maintained for a period of time. The emulsion is then cooled to about 35° C. or less to stop chemical sensitization.

In one embodiment of the invention a surfactant is added after Dye 2. One of the inherent problems of using a combination of anionic and cationic sensitizing and antenna dyes to increase light absorption and speed is the diminution or possible neutralization of the effective ionic charge of the dyed emulsion grains via electrostatic complexation between the anionic and cationic dyes. This effectively reduces the inter-grain electrostatic repulsive forces helping to stabilize the dispersed emulsion grains in the melt against coagulation and can lead to grain clumping and sensitometric granularity and fog increases. However, it has been discovered that the addition of certain surfactants at well defined concentrations to the dye-layered emulsion effectively minimized this grain clumping by providing electrostatic and steric stabilization to the emulsion grains via adsorbed surfactant layers and surfactant-gelatin complexes. In general, addition of the self-same surfactants to conventionally dyed (spectrally-sensitized but non-dye-layered) emulsion grains did not provide the same beneficial improvement in granularity and fog.

A surface-active agent (surfactant) is a substance that, when present at low concentration in a system, has the property of adsorbing onto the surfaces or interfaces of the system and of altering to a marked degree the surface or interfacial free energies of those surfaces (or interfaces). When the interfacial area is very large relative to the volume of the system a substantial fraction of the total mass of the system is present at interfaces (e.g. in emulsions and colloidal dispersions). Under these circumstances surfactants can play a major role in the system.

Surfactants have a characteristic molecular structure consisting of a structural group that has very little attraction for solvent together with a group that has strong attraction for solvent known as the hydrophobic tail groups and hydrophilic head groups respectively for aqueous-based systems. Depending upon the nature of the hydrophilic group, surfactants are generally classified as:

1. Anionic where the surface-active portion of the molecule bears a negative charge, for example $RCOO^-Na^+$ ("soap") and $RC_6H_4SO_3^-Na^+$ (alkylbenzesulfonate).
2. Cationic where the surface-active portion bears a positive charge, for example, $RNH_3^+Cl^-$ (salt of a long-chain amine), $RN(CH_3)_3^+Cl^-$ (quaternary ammonium chloride).
3. Zwitterionic where both positive and negative charges may be present in the surface-active portion, for example, $RN^+H_2CH_2COO^-$ (long-chain amiino acid), $RN^+(CH_3)_2CH_2CH_2SO_3^-$ (sulfobetaine).
4. Nonionic where the surface-active portion bears no apparent ionic charge, for example, $RCOOCH_2CHOHCH_2OH$ (monoglyceride of long-chain fatty acid), $RC_6H_4(OC_2H_4)_xOH$ (polyoxyethylenated alkylphenol).

A surfactant may comprise 1 or many hydrophobic tail groups. Preferably the surfactants utilized in this invention comprise two or three hydrophobic tail groups. Examples of typical surfactant hydrophobic groups include:

1. Straight-chain, long alkyl groups (e.g. C8 to C20).
2. Branched-chain, long alkyl groups (e.g. C8 to C20).
3. Long-chain (C8 to C15) alkylbenzene residues.
4. Alkylnaphthalene residues (C3 and longer alkyl groups).
5. Rosin derivatives.
6. High-molecular-weight propylene oxide polymers (polyoxypropylene glycol derivatives).
7. Long-chain perfluoroalkyl groups.
8. Polysiloxane groups.

One very important fundamental physical property of all surfactant types (anionic, cationic, zwitterionic and nonionic), which affects interfacial phenomena both directly and indirectly, is micelle fonrnation, or micellization, where the surfactant molecules spontaneously self-assemble in solution to form dynamic colloidal-sized clusters (aggregates or micelles). The concentration at which this phenomenon occurs is called the critical micelle concentration (CMC). In many instances of surfactant adsorption at the solid-liquid interface, the equilibrium concentration of surfactant in the liquid phase necessary to saturate the solid surface is in the vicinity of the critical micelle concentration. Surfactant adsorption to solid surfaces can be an important mechanism for promoting steric and charge-stabilization to solid particles dispersed in solvent media to provide stability against flocculation and coagulation.

Experimental quantification of the CMC value may be made from the pronounced changes or discontinuities of surfactant physical properties such as electrical conductivity, surface tension and light scattering as a function of surfactant concentration in solution. In general, the CMC in aqueous media decreases as the hydrophobic character of the surfactant increases. Among the factors known to affect the CMC markedly in aqueous solution are (1) the structure of the surfactant, (2) the presence of added electrolyte in the solution, (3) the presence in the solution of various organic additives, and (4) the temperature of the solution.

In aqueous solutions containing hydrophilic polymers such as gelatin (e.g. silver halide-based photographic melts) micelle formation may be a more mechanistically complex phenomenon, particularly with charged (e.g. anionic) surfactants which may interact both electrostatically and hydrophobically with the gelatin molecule. This is illustrated with reference to FIG. 1, a schematic representation of static surface tension versus log (concentration) for a typical anionic surfactant. When the surface tension of a surfactant solution is measured as a function of its log concentration in water (in the absence of gelatin), it is well known that the resulting curve is typically sigma-shaped (M. J. Rosen, surfactants and Interfacial Phenomena $2^{nd}$ Edition, Wiley, 1989, p.69). In very dilute solution there is little change with concentration and the surface tension remains close to the solvent value. As the concentration is increased, the surface tension begins to drop significantly, becoming a relatively steep function of concentration. Eventually the surface tension value approaches a limiting value and thereafter shows little or no change with concentration. This is the point where the surfactant commences to aggregate in solution to form micelles (the CMC).

In the presence of hydrophilic polymers such as gelatin, however, two distinct plateau regions may be observed, the onset of which correspond to CMC1 (also known as the CAC or Critical Aggregation Concentration) at a relatively low concentration and CMC2 at a correspondingly higher concentration (WO 02/053391 A1, Publication date 11 Jul. 2002). The former critical micelle concentration (CMCI or CAC) corresponds specifically to surfactant micellar association (binding) with gelatin and may occur at surfactant concentrations as much as one order of magnitude lower than the aqueous CMC (depending upon surfactant structure). The latter critical micelle concentration (CMC2) is invariably higher than the surfactant's CMC in water and corresponds to the formation of essentially "free" (non-gelatin-bound) micelles in bulk solution. The concentration latitude of the first plateau region between the CAC and CMC2 depends upon the structure and hydrophobicity of the particular surfactant, and the concentration of the hydrophilic polymer, and as such may extend over orders of magnitude. In our experimental determinations of CAC, the chosen gelatin concentration of 7% w/w is representative of typical photographic emulsion melts.

By measuring the static surface tension of aqueous gelatin melts containing a surfactant at various well-defined concentrations and plotting the results as a function of log (surfactant concentration), the logarithm of the critical aggregation concentration can be identified. Any suitable method may be used to measure static surface tension of liquids. In the present examples, the static surface tensions of a range of surfactant concentrations are measured in aqueous solution containing 7% w/w deionized type IV gelatin under a standard set of conditions at 40° C. The concentration of the surfactant is usually varied from 0.0001 to 0.3 wt % in log concentration intervals of ~0.5. Higher or intermediate concentrations are sometimes measured as necessary to improve the estimates of the critical aggregation concentrations CMC1 (CAC) or to extend the concentration range towards the CMC2. The static surface tension (SST) measurements may be made using the Wilhelmy blade method as described by Padday, J F, $2_{nd}$ Int. Congress of Surface Activity, Butterworths, 1957, 1, 1. The SST measurements can be made with an overflowing circular cylinder, having a diameter of 37.5 mm and a liquid overflow rate of ~9 ml/sec. These "static" measurements are not true equilibrium values, but values taken after a defined and controlled period. Representative SST values were obtained by, stopping the flow in the dynamic cell, waiting 30 seconds, raising the surface of the liquid until it just touches the Wilhelmy blade, momentarily dipping the blade by electromechanical means to induce wetting, and taking a final reading 60 seconds later, i.e., 90 seconds after stopping the flow. The CMC1 (CAC) data for a range of surfactant structures in 7% w/w deionized type IV gelatin at 40° C. is given in Table A. The CMC2 value was not measurable for any of the surfactants at concentrations of 0.3% w/w, or less.

According to the first aspect of the present invention, certain surface-active materials (surfactants) added directly to a dye-layered (antenna-sensitized) emulsion, either as part of the emulsion finish procedure or as a post-finish emulsion melt addendum, effectively improve the fog and granularity position of the dye-layered emulsion. For the case where the silver halide-adsorbed sensitizing dye layer is predominantly negatively charged (e.g. anionic or anionic plus zwitterionic cyanine dyes) and the associated antenna dye is inherently positively charged (cationic), negatively-charged surfactants produce the most beneficial effects. Anionic surfactants are most preferred. When used over appropriate definable concentration ranges in the emulsion melt a wide range of disparate anionic surfactant structures provide a significant improvement in performance. Of these materials, the hydrophobic structural variations included, for example, single-chain, double-chain and tri-chain surfactants, straight-chain and branched-chain surfactants. In general, as the surfactant becomes more hydrophobic (lower CMC), some degree of chain branching or ring-substitution may be beneficial (irrespective of the number of hydrophobic chains) since these materials generally possess lower Krafft points (the temperature at which the surfactant becomes sufficiently soluble to allow micellization to occur), particularly in the presence of divalent cations normally found in gelatin. Similarly, sulphate and sulphonate anionic headgroups may be preferred over carboxylates because of their lower sensitivity to the presence of neutral electrolytes, divalent cations and low pH. The double-chain (two hydrophobic tail groups) sulphosuccinate esters, exemplified by Aerosol-OT, and the tri-chain sulphotricarballylates (three hydrophobic tail groups) are preferred, though satisfactory improvements can be realized from a broad range of single-chain anionic surfactants. Other double-chain surfactant classes such as lipids (e.g. phosphatidylcholines), di-glycerides and phosphate diesters may also prove effective. Certain pH-sensitive zwitterionic surfactants which may be rendered net anionic (i.e. negatively charged) over suitable pH ranges, e.g. β-N-alkylaminopropionic acids and N-alkyl-β-iminodipropionic acids, may prove effective by analogy with the anionic surfactants reported here. On the whole, nonionic surfactants and positively-charged cationic surfactants were found to be less effective compared to the anionic surfactants.

According to the invention, preferred anionic surfactants should possess a Critical Aggregation Concentration value (CAC also known as CMC1) in a 7% w/w deionized type IV gelatin melt at 40° C. which falls in the concentration range from $10^{-2}$ to $10^{-6}$ moles/kg (molal), and more preferably $10^{-2}$ to $10^{-5}$ moles/kg (molal). Moreover, the optimal concentration range of these preferred surfactants for use with dye-layered silver halide emulsion melts falls within a specified range with respect to their individual CAC (CMC1) and CMC2 values as determined experimentally. The most preferred anionic surfactants would also be low-foaming in aqueous media. In general, significant improvements in performance were observed when the anionic surfactant was added to the melt at a bulk concentration in the general vicinity (usually in slight excess) of its experimentally-determined CAC value. However, satisfactory improvements in performance may also be realized at bulk surfactant concentrations significantly higher and lower that the CAC, within experimentally defined limits. The maximum effective concentration for each surfactant falls within the concentration range defined by the CAC (CMC1) and CMC2 values. The concentration latitude of the first plateau region between the CAC and CMC2 depends upon the structure and hydrophobicity of the particular surfactant, and the concentration of the hydrophilic polymer, and as such may extend over orders of magnitude. In our experimental determinations of CAC, the chosen gelatin concentration of 7% w/w is representative of typical photographic emulsion melts. For example, the surfactant S-4 exhibits a much shorter concentration plateau compared to the more hydrophobic surfactant DOX-3. In practice, the surfactant may be added at a concentration in the range of $10^{-1}$ times its CAC value and [CAC+70% of (CMC2−CAC)], more preferably at a concentration in the range of $10_{-1}$ times its CAC value and [CAC+50% of (CMC2−CAC)], and most preferably at a concentration in the range of $10^{-1}$ times its CAC value and [CAC+30% of (CMC2−CAC)]. As the bulk concentration approaches or exceeds the CMC2 value the photographic speed advantage conferred by the additional antenna dye layer is eroded or eradicated as the cationic dye becomes desorbed from the dyed emulsion and solubilized by the surfactant micelles. In the absence of a single "ideal" behaving surfactant for any given dye-layered application, it is anticipated that mixtures (combinations) of surfactants may be used to fine-tune the surfactant performance (e.g. mixtures of differently charged surfactants, mixtures of hydrocarbon and fluorocarbon-based surfactants, mixtures of surfactants with disparate hydrophobicities).

Table A contains experimentally determined CAC values (also commonly referred to as CAC1 values) for a variety of surfactants in 7% w/w deionized gelatin at 40° C.

TABLE A

| Surfactant | Log (CAC) | CAC (Moles/kg) | CMC2 (Moles/kg) |
|---|---|---|---|
| S-1 | −3.893 | $1.3 \times 10^{-4}$ | $>6.7 \times 10^{-3}$ |
| S-2 | −3.209 | $6.2 \times 10^{-4}$ | $>6.2 \times 10^{-3}$ |
| S-3 | −3.702 | $2.0 \times 10^{-4}$ | $>6.7 \times 10^{-3}$ |
| S-4 | −3.433 | $3.7 \times 10^{-4}$ | $>5.8 \times 10^{-3}$ |
| S-5 | −3.349 | $4.5 \times 10^{-4}$ | $>6.1 \times 10^{-3}$ |
| S-6 | −2.992 | $1.0 \times 10^{-3}$ | $>6.1 \times 10^{-3}$ |
| S-7 | −3.832 | $1.5 \times 10^{-4}$ | $>5.7 \times 10^{-3}$ |
| S-8 | −3.028 | $9.4 \times 10^{-4}$ | $>6.1 \times 10^{-3}$ |
| S-9 | −2.798 | $1.6 \times 10^{-3}$ | $>6.1 \times 10^{-3}$ |
| S-10 | −3.641 | $2.3 \times 10^{-4}$ | $>1.0 \times 10^{-2}$ |
| S-12 | −3.153 | $7.0 \times 10^{-4}$ | $>8.1 \times 10^{-3}$ |
| S-13 | −2.774 | $1.7 \times 10^{-3}$ | $>8.4 \times 10^{-3}$ |
| S-14 | −2.849 | $1.4 \times 10^{-3}$ | $>7.1 \times 10^{-3}$ |
| S-16 | −3.917 | $1.2 \times 10^{-4}$ | $>1.1 \times 10^{-2}$ |
| DOX-3 | −4.854 | $1.4 \times 10^{-5}$ | $>2.6 \times 10^{-3}$ |
| S-27 | −3.456 | $3.5 \times 10^{-4}$ | $>3.2 \times 10^{-3}$ |

Some suitable surfactants for use in the invention are shown below.

S-1
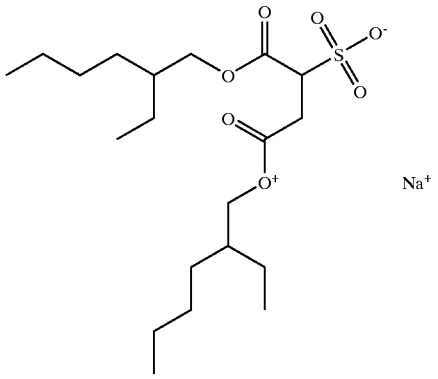
S-2
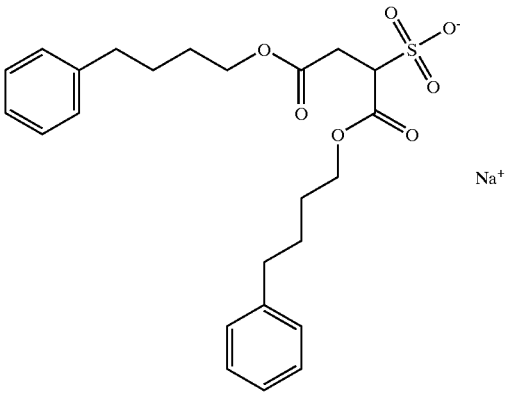
S-3
ROOC•CH$_2$
|
ROOC•CH•SO$_3$Na
Where R = CH$_2$CH$_2$•CH(CH$_3$)•CH$_2$C(CH$_3$)$_3$
S-4
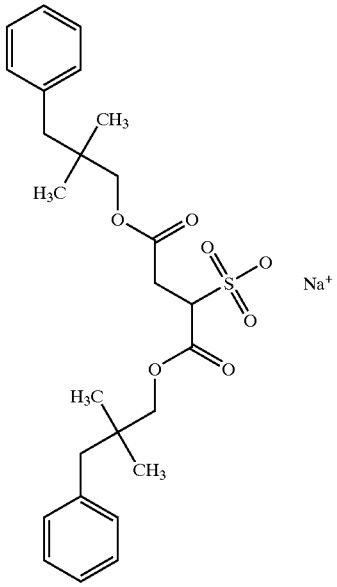
-continued
S-5
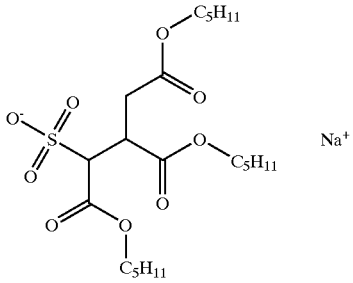
S-6
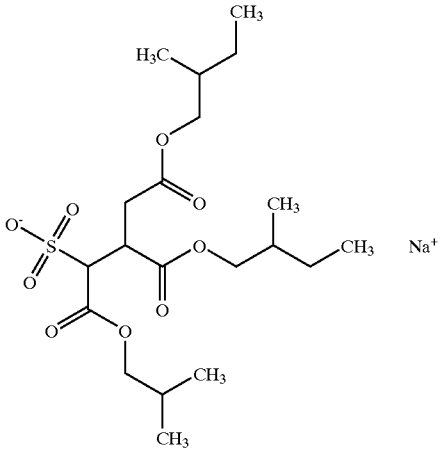
S-7
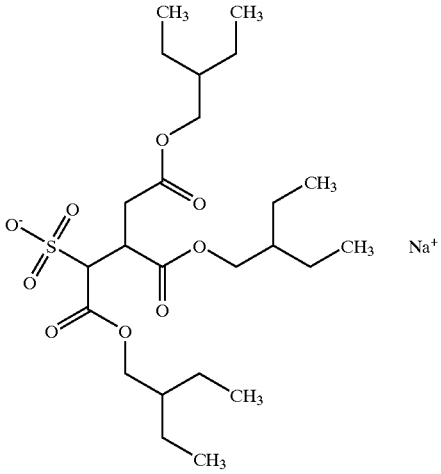

-continued

S-8

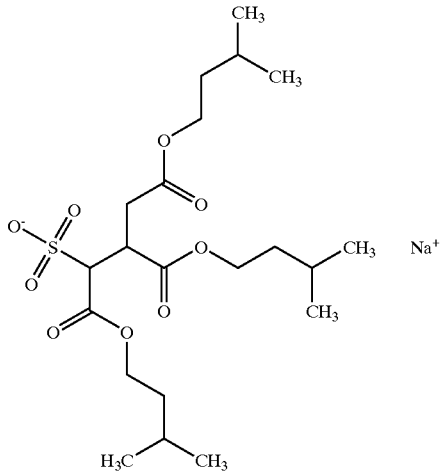

S-9

ROOC•$CH_2$
|
ROOC•CH
|
ROOC•CH•$SO_2Na$

Where R = $CH_2C(CH_3)_3$

S-10 $CH_3(CH_2)_{11}OSO_3Na$

S-11 $C_{12}H_{25}C_6H_4SO_3Na$

S-12 $CH_3(CH_2)_{17}OSO_3Na$

S-13

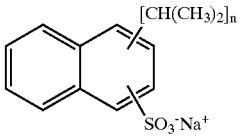

n = 2 or 3 (mixture)

MIXTURE OF

S-14

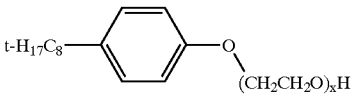

x = approx 3 and

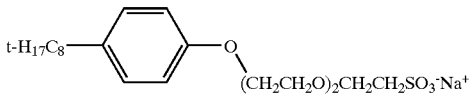

S-15 $(CH_3)(CH_2)_{11}O(CH_2CH_2O)_{30}SO_3NH_4$

S-16 $(CH_3)(CH_2)_{11}O(CH_2CH_2O)_{12}SO_3NH_4$

S-17 $C_{12}H_{25}(OCH_2CH_2)_4OH$

S-18 $C_{16}H_{33}(OCH_2CH_2)_2OH$

S-19 $C_{16}H_{33}(OCH_2CH_2)_{10}OH$

S-20 $C_{16}H_{33}(OCH_2CH_2)_{20}OH$

S-21 $C_{18}H_{37}(OCH_2CH_2)_{10}OH$

S-22 $C_{18}H_{35}(OCH_2CH_2)_{20}OH$

In another embodiment of the invention a scavenger for oxidized developer (Dox scavenger) is added after Dye 2 without a surfactant as described above. While any known class of Dox scavenger can be used with the emulsions of this invention, the preferred Dox scavengers are those derived from para-hydroquinones and hydrazides, with hydroquinones being preferred. In one preferred embodiment the Dox scavenger contains an anionic water-solubilizing group, preferably a sulfo group The preferred structures of para-hydroquinone scavengers are represented by Formula (I):

(Formula I)

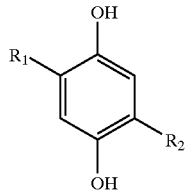

where $R_1$ and $R_2$ are independently hydrogen, or alkyl, aryl, alkyloxy, or amino groups (including aminocarbonyl and aminosulfonyl) or sulfonic or carboxylic acid (including their salts); with the proviso that $R_1$ and $R_2$ cannot both be hydrogen and that the sum total of carbon atoms between $R_1$ and $R_2$ is at least 8. In one preferred embodiment, at least one of $R_1$ or $R_2$ is a sufonic acid or a carboxylic acid, or a salt thereof. If $R_1$ or $R_2$ is alkyl, it is preferred that it is branched at the position next to the hydroquinone ring. $R_1$ and $R_2$ may be additionally substituted with water-solubilizing groups which include sulfonic acid and its salts, carboxylic acid and its salts, hydroxyl groups, polyethers, phosphates, quaternary ammonium groups, carbamoyl or carboxylic ester groups.

In the embodiment wherein at least one of $R_1$ or $R_2$ is a sulfonic acid or a carboxylic acid, or a salt thereof and the sum total of carbon atoms between $R_1$ and R2 is at least 8, the hydroquinone Dox scavenger begin to resemble a surfactant. Such Dox scavengers are particularly useful in this invention, combining, for example, the beneficial surface-active properties of, for example, a long-chain anionic alkyl benzenesulphonate surfactant with the beneficial oxidized-developer scavenging properties of the hydroquinone moiety to produce an anionic surfactant-like oxidized-developer scavenger (i.e. a redox-reactive surfactant), such as DOX-3. Such materials may also be designed and optimized for use according to the guidelines set forth for surfactants relative to their CAC and CMC2 values in aqueous gelatin. One preferred example of such a molecule is DOX-3 which when added alone to a dye-layered emulsion at a concentration in the approximate range 1.1 to 4.3 millimoles per silver mole provides significant improvements in granularity and D-min with a minimal but acceptable loss of photographic speed. In these instances, the resulting dye-layered emulsion remains significantly advantaged for speed when compared to the exact same spectrally and chemically-sensitized emulsion without dye layering.

The preferred structure of hydrazide Dox scavengers are represented by Formula II:

(Formula II)

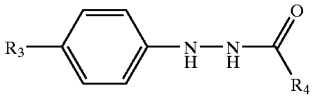

where $R_3$ is an electron-donation group such as an amino, oxy or alkyl group. $R_4$ is an alkyl, aryl, amino, thio or oxy group. It is preferred that the sum total of carbon atoms between $R_3$ and $R_4$ is at least 8 and more preferred that the hydrazide contains a water solubilizing group as defined above. Particularly useful hydrazides are where $R_3$ is amino or oxy group and $R_4$ is alkyl or aryl group.

Dox scavengers that contain water-solubilizing groups may be added as water solution, as solutions in water miscible organic solvents such as methanol or acetone or as dispersions in a permanent organic oil. Scavengers that do not contain water solubilizing groups are typically added as dispersions. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. In these instances, the surfactant is essentially adsorbed (bound) at the oil-water interface of the dispersion droplet and is usually not free in sufficient concentration to interact with a dye-layered emulsion in the inventive manner described herein. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, alcohols and esters. When a solvent is present, it is preferred that the weight ratio of compound to solvent be at least 1 to 0.5, or most preferably, at least 1 to 1. The dispersion may require an auxiliary permanent solvent initially to dissolve the component but this is removed afterwards, usually either by evaporation or by washing with additional water. Some examples of suitable auxiliary permanent solvents are ethyl acetate, cyclohexanone and 2-(2-butoxyethoxy)ethyl acetate.

The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials of the invention may also be dispersed as an admixture with another component of the system such as a coupler so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity. Regardless of the method of addition it is preferred that the scavenger for oxidized developer is added at a concentration of less than 5 mmoles per silver mole. Higher levels may result in unacceptable speed losses due to the inherent oxidized-developer scavenger properties of such materials.

Some examples of preferred Dox scavengers that are included in the invention are as follows:

DOX-1

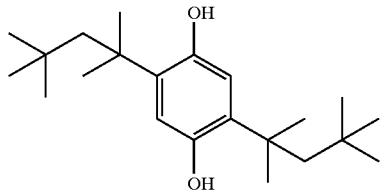

DOX-2

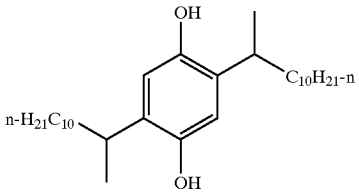

DOX-3

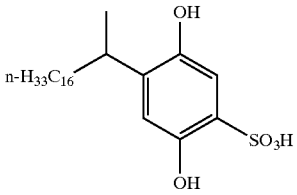

DOX-4

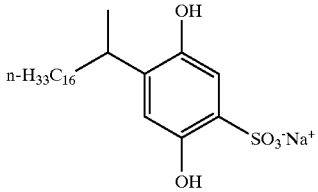

DOX-5

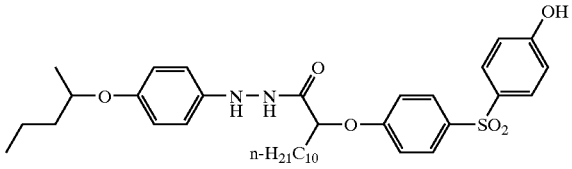

DOX-6

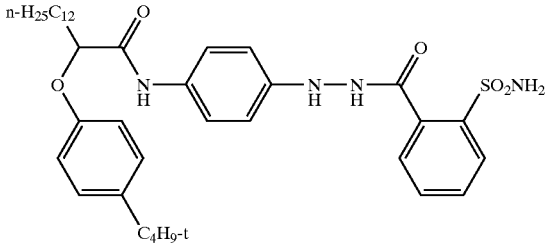

-continued
DOX-7
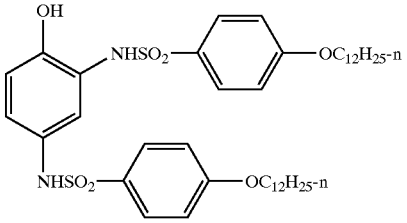
DOX-7
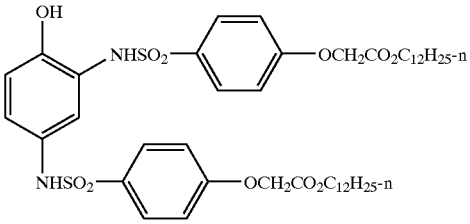
DOX-8
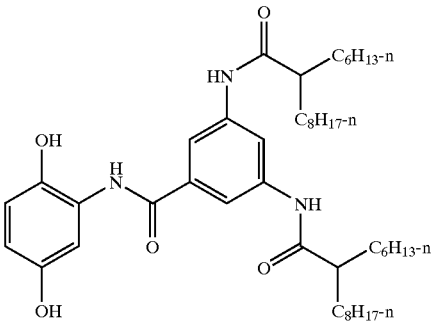
DOX-9
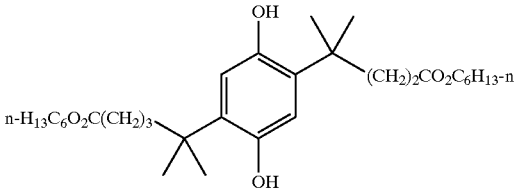
DOX-10
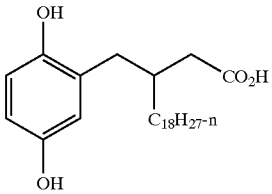
DOX-11
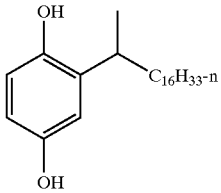
DOX-12
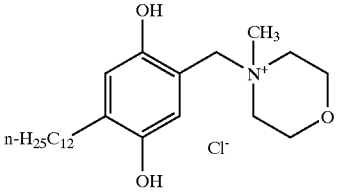
-continued
DOX-13
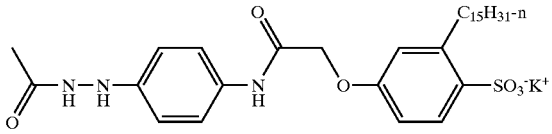
DOX-14
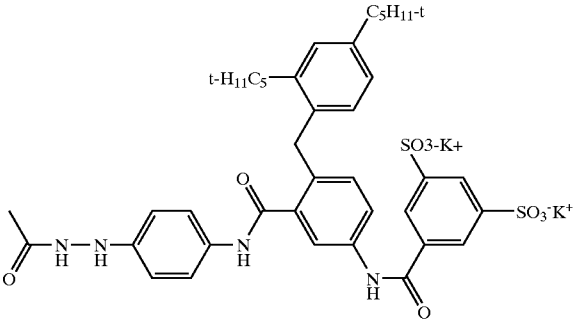
DOX-15
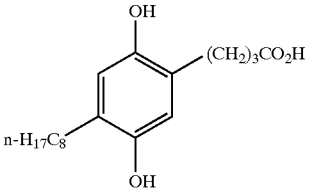
The following are examples usefwi but less preferred Dox scavengers:
DOX-16
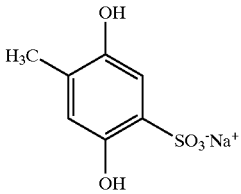
DOX-17
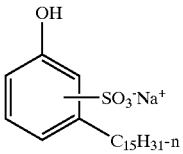
DOX-18
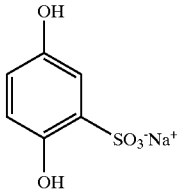
DOX-19
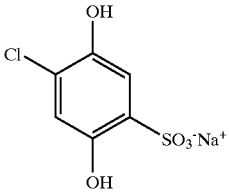

-continued

DOX-20

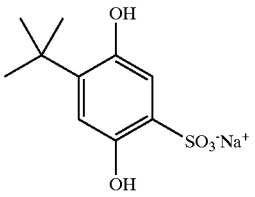

DOX-21

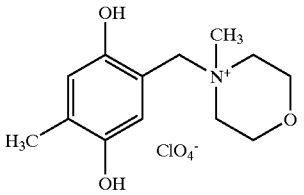

DOX-22

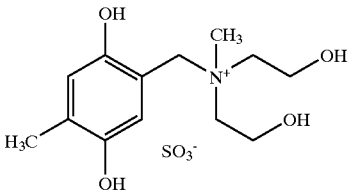

In a more preferred embodiment of the invention additional improvements in fog and granularity may be realized (relative to adding a preferred anionic surfactant alone), with minimal or no loss in photographic speed, by adding an optimum level of an above described surfactant, particularly an anionic surfaciant, such as Aerosol-OT, in combination with an above described oxidized-developer scavenger. Equivalent improvements in fog and granularity could not be achieved by adding these oxidized-developer scavengers alone to the dye-layered emulsion (i.e. without the preferred surfactant addition) without using significantly higher scavenger levels at the expense of considerable photographic speed. When a Dox scavenger is used in combination with a surfactant it is preferred that the surfactant is a non-redox reactive surfactant (i.e. it does not react with oxidized developer). The surfactants and Dox scavengers which may be utilized are as described above. DOX-3 is particularly useful in combination with an anionic surfactant. The Dox and the surfactant are both added at some point after Dye 2. They may be added together or separately.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy, aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamnido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonyl amino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylurcido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesul fonamido, N-methyltetradecylsulfonamido, N,N-dipropylsulfamoylamino, and hexadecylsulfonamido; sulfamoyl, such as N-methylsulfamnoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl), such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxypbenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethyihexylsulfinyl, dodecylsulfinyl, hexadecylsulfinyl, phenylsulfinyl, 4-nonylphenylsulfinyl, and p-tolylsul finyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quatemary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one embodiment of the invention the emulsion containing the dye layered grains containing the antenna dye described herein is in the magenta dye forming unit. Particularly useful is a silver halide photographic element wherein the silver halide photographic element further comprises a yellow filter dye in a layer between the support and the green sensitized layer closest to the support. A preferred dye is show below.

YFD-1

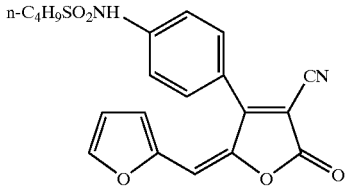

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and Germnan OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimiidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

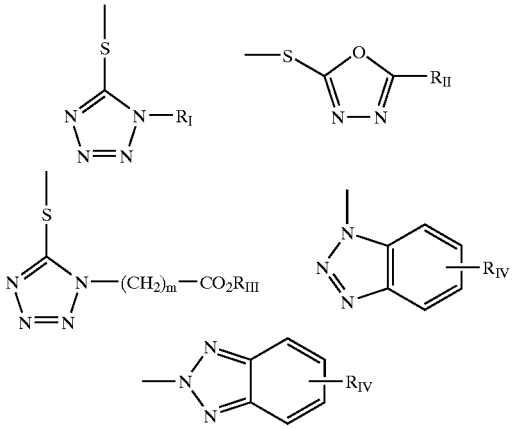

wherein $R_1$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and -$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

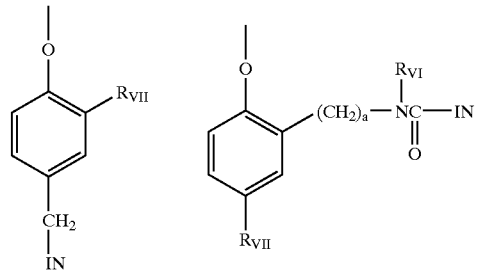

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer to down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

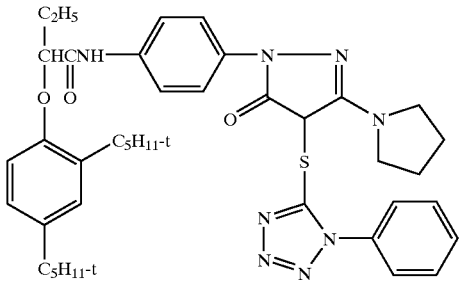

D2

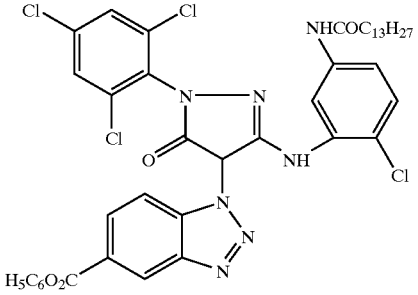

-continued
D3
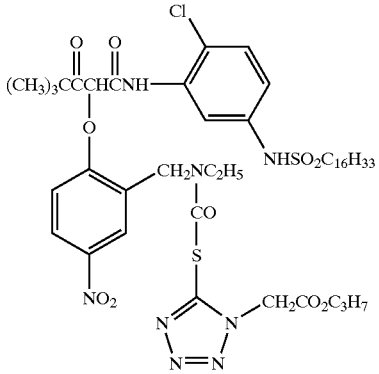
D4
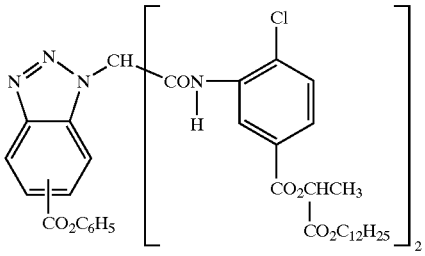
D5
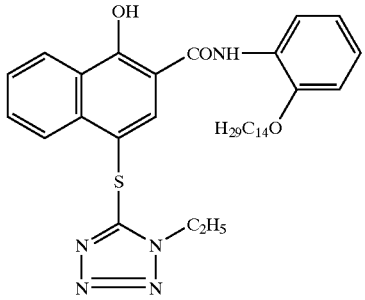
D6
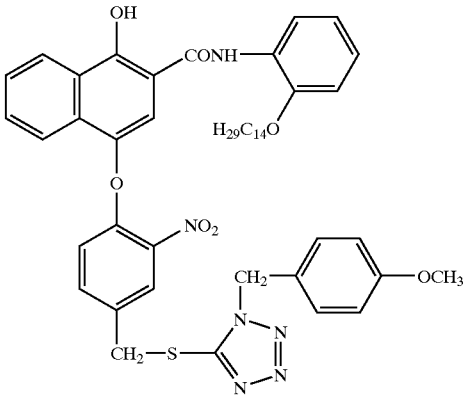
-continued
D7
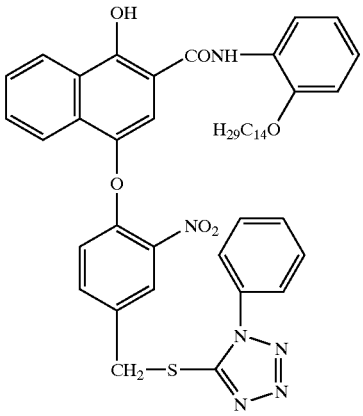
D8
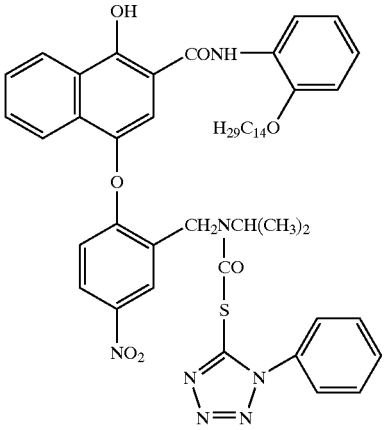
D9
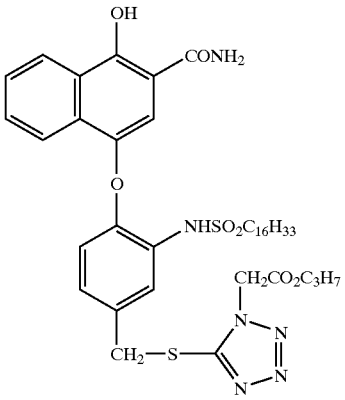

-continued

D10

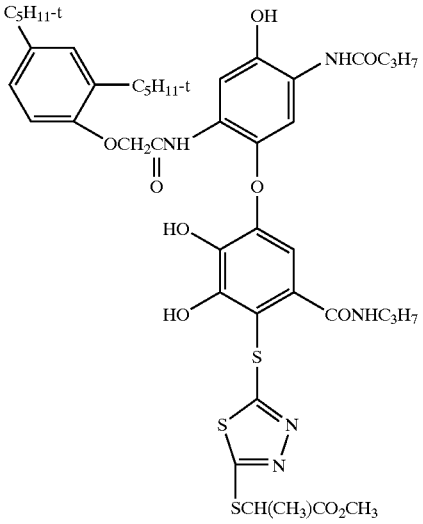

D11

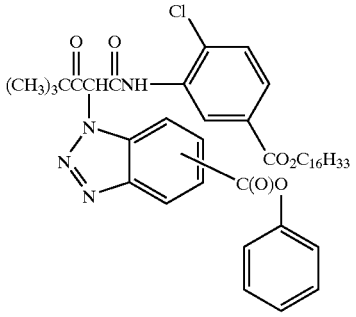

D12

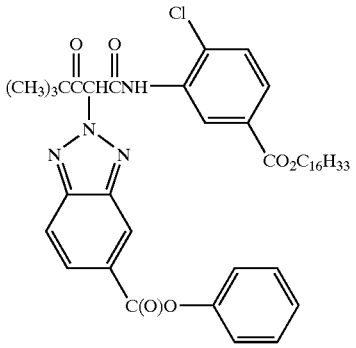

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process*, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than So mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in (he face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin—that is, their average thickness is less than 0.07 $\mu$m.

The useful average grain ECD of a tabular grain emulsion can range up to about 15 $\mu$m. Except for a very few high speed applications, the average grain ECD of a tabular grain emulsion is conventionally less than 10 $\mu$m, with the average grain ECD for most tabular grain emulsions being less than 5 $\mu$m.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111 } tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151. Chaffee et al U.S. Pat. No. 5,358,840, Deaton et al U.S. Pat. No. 5,726,007, King et al U.S. Pat. No. 5,518,872, Levy et al U.S. Pat. No. 5,612,177, Mignot et al U.S. Pat. No. 5,484,697, Olm et al U.S. Pat. No. 5,576,172, Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section 1. Emulsion grains and their preparation, sub-section G. Grain modifying conditions and adjustments, paragraphs (3), (4) and (5), can be present in the emulsions of the invention. Especially useful dopants are disclosed by Marchetti, et al., U.S. Pat. No. 4,937,180, and Johnson, et al., U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention:

EXAMPLES

Example 1a

Film coating evaluations were carried out in color format on a sulfur-and-gold sensitized 1.10 μm×0.115 μm silver bromide tabular emulsion containing 4.5 mole % iodide. The emulsion was heated to 43° C. and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 was added. After a 20' hold, the second sensitizing dye GSD-2 was added with a subsequent 20' hold. This was followed by the addition of sodium aurous dithiosulfate dihydrate (2.19 mg/Ag mole). After a 2' hold, sodium thiosulfate pentahydrate (1.0 mg/Ag mole) was added, followed by a 2' hold. The emulsion was held for 22' at 60° C. After cooling to 43° C., 4-hydroxy-6-methyl-1,3,3a,7-tetraazaindene, sodium salt, monohydrate, (TAI) (1 g/Ag mole) was added and then held for 2'. This was followed by the addition of 1-(3-acetamidophenyl)-5-mercaptotetrazole (APMT)(25 mg/Ag mole) and a subsequent hold for 2'. Then GSD-3 layering dye was added at 1.2 mmole/Ag mole, followed by a 30' hold. Next, an oxidized developer scavenger (see table) was added at 4.3 mmole/Ag mole, followed by a 5' hold. The melt was subsequently chilled at 5° C. Before coating, the emulsion was combined with gelatin and distilled water to a concentration of 0.15 Ag mole/kg; and subsequently heated to 40° C. to mix components. Single-layer coatings were made on acetate support. Silver lay down was 807 mg/m$^2$ (75 mg/ft$^2$). The silver melt was combined with a coupler dispersion containing a magenta forming coupler MC-1 at a lay down of 226 mg/m$^2$ (21 mg/ft$^2$). Gelatin lay down was 3228 mg/m$^2$ (300 mg/ft$^2$). A hardened overcoat was at 2690 mg/m$^2$ (250 mg/ft$^2$) gelatin. Sensitometric exposures (0.01 sec) were done using tungsten exposure with filtration to stimulate a daylight exposure. The described elements were processed for 3.25' in the known C-41 color process. The relative granularity at Dmin is given in grain units. Dye-layered emulsion without Dox scavenger relative to unlayered base finish exhibits increased Dmin, increased speed, increased Dmin granularity, and lowered gamma. A group of oxidized-developer scavengers were evaluated in order to obtain layered emulsions with low Dmin and Dmin granularity. As seen in the following table, APMT and TAI added with the layering dye resulted in higher Dmin and granularity compared to the unlayered reference emulsion. DOX-3 was most effective of the three compounds in reducing Dmin and granularity produced by the addition of layering dye. The remaining two compounds, DOX-5 and DOX-1, reduced Dmin but with less effect on granularity.

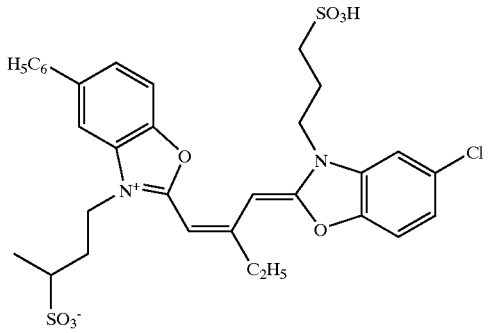

GSD-1

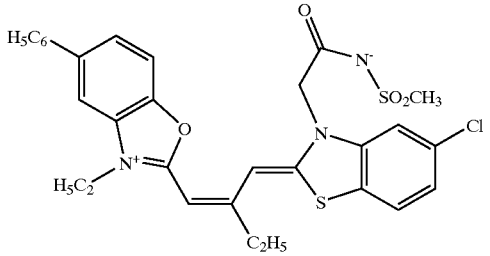

GSD-2

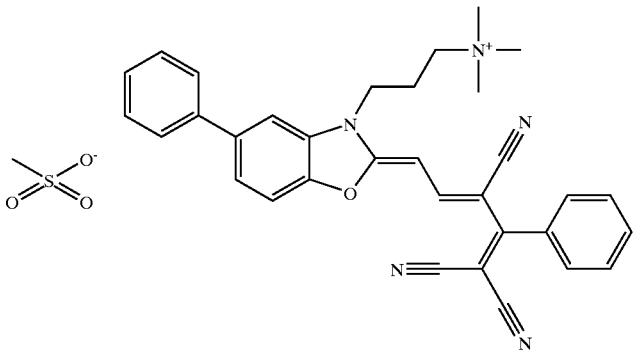

GSD-3

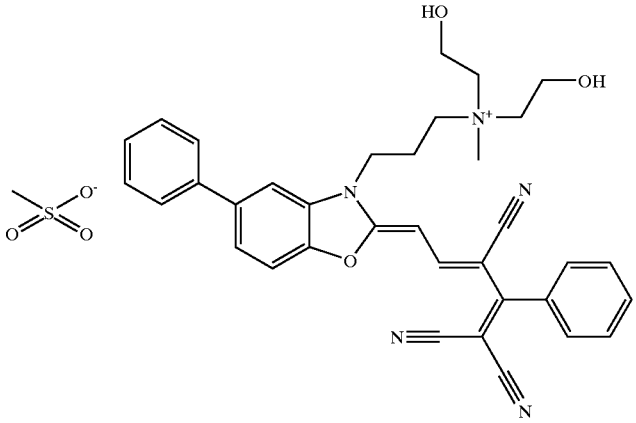

GSD-4

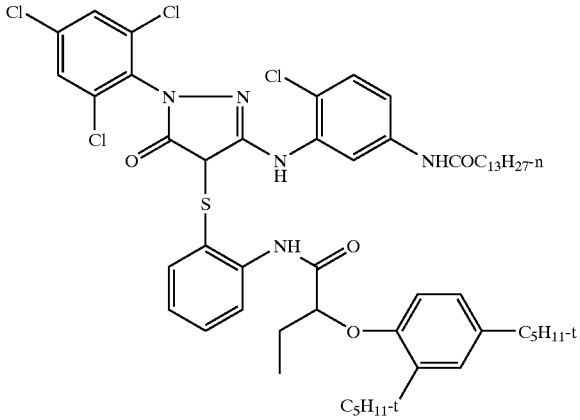

MC-1

| Sample | | Sensitization | ΔDmin | Relative Granularity @ D min | Normalized Relative Sensitivity @ 0.15 D | ΔGamma |
|---|---|---|---|---|---|---|
| 1 | Comparison | 0 | −0.10 | −11.9 | 69 | +0.33 |
| 2 | Comparison | DOX-3 | −0.11 | −15.1 | 65 | +0.44 |
| 3 | Ref. | GSD-3 | 0 | 0 | 100 | 0 |
| 4 | Invention | GSD-3 + DOX-3 | −0.06 | −11.9 | 87 | +0.19 |
| 5 | Invention | GSD-3 + DOX-5 | 0.06 | 3.3 | 93 | +0.10 |
| 6 | Invention | GSD-3 + DOX-1 | −0.05 | −5.5 | 87 | +0.05 |

Example 1b

Film coating evaluations were carried out in color format on a sulfur-and-gold sensitized 1.62 μm×0.131 μm silver bromide tabular emulsion containing 4.5 mole % iodide. The emulsion was heated to 43° C. and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 was added. After a 20' hold, the second sensitizing dye GSD-2 was added with a subsequent 20' hold. This was followed by the addition of sodium aurous dithiosulfate dihydrate (2.32 mg/Ag mole). After a 2' hold, sodium thiosulfate pentahydrate (1.1 mg/Ag mole) was added, followed by a 2' hold. The emulsion was held for 6' at 62° C. After cooling to 43° C., 4-hydroxy-6-methyl-1,3,3a,7-tetraazaindene, sodium salt, monohydrate (1 g/Ag mole) was added and then held for 2'. This was followed by the addition of 1-(3-acetamidophenyl)-5-mercaptotetrazole (25 mg/Ag mole) and a subsequent hold for 2'. Then the GSD-3 layering dye was added at 1.2 mmole/Ag mole, followed by a 30' hold. Next, an oxidized developer scavenger (see table) was added at 4.3 mmole/Ag mole, followed by a 5' hold. The melt was subsequently chilled at 5° C. Before coating, the emulsion was combined with gelatin and distilled water to a concentration of 0.15 Ag mole/kg; and subsequently heated to 40° C. to mix components. Single-layer coatings were made on acetate support. Silver lay down was 807 mg/m$^2$ (75 mg/ft$^2$). The silver melt was combined with a coupler dispersion containing a magenta forming coupler MC-1 at a lay down of 226 mg/m$^2$ (21 mg/ft$^2$). Gelatin laydown was 3228 mg/m$^2$ (300 mg/ft$^2$). A hardened overcoat was at 2690 mg/m$^2$ (250 mg/ft$^2$) gelatin. Sensitometric exposures (0.01 sec) were done using tungsten exposure with filtration to stimulate a daylight exposure. The described elements were processed for 3.25' in the known C-41 color process. The relative granularity at Dmin is given in grain units. Relative to the unlayered sensitized emulsion, the dye-layered emulsion without Dox scavenger exhibits increased Dmin, increased speed, increased Dmin granularity, and decreased gamma. Several other oxidized-developer scavengers that do not have surfactant properties were evaluated in order to determine whether they provide layered emulsions with low Dmin and minimal impact on granularity. As seen in the following table, APMT and TAI added with the layering dye resulted in higher Dmin and granularity compared to the unlayered reference emulsion. DOX-3 was most effective of list of compounds in reducing Dmin and granularity produced by the addition of layering dye. The unique feature of DOX-3 is the pendant long-chain hydrocarbon group giving the molecule surfactant properties. The other compounds do not have surfactant properties.

(35 mg/Ag mole) was added followed by a 2' hold. Then the first sensitizing dye GSD-1 was added. After a 20' hold, the second sensitizing dye GSD-2 was added with a subsequent 20' hold. This was followed by the addition of sodium aurous dithiosulfate dihydrate (2.32 mg/Ag mole). After a 2' hold, sodium thiosulfate pentahydrate (1.1 mg/Ag mole) was added, followed by a 2' hold. The emulsion was held for 6' at 62° C. After cooling to 43° C., 4-hydroxy-6-methyl-1,3,3a,7-tetraazaindene, sodium salt, monohydrate, (1 g/Ag mole) was added and then held for 2'. This was followed by the addition of 1-(3-acetamidophenyl)-5-mercaptotetrazole (25 mg/Ag mole) and a subsequent hold for 2'. Then the GSD-3 layering dye was added at 1.2 mmole/Ag mole, followed by a 30' hold. Next, DOX-3 or any of the anionic surfactants (see table) was added at 4.3 mmole/mole, followed by a 5' hold. The melt was subsequently chilled at 5° C. Before coating, the emulsion was combined with gelatin and distilled water to a concentration of 0.15 Ag mole/kg; and subsequently heated to 40° C. to mix components. Single-layer coatings were made on acetate support. Silver lay down was 807 mg/m$^2$ (75 mg/ft$^2$). The silver melt was combined with a coupler dispersion containing a magenta forming coupler MC-1 at a lay down of 226 mg/m$^2$ (21 mg/ft$^2$). Gelatin lay down was 3228 mg/m$^2$ (300 mg/ft$^2$). A hardened overcoat was at 2690 mg/m$^2$ (250 mg/ft$^2$) gelatin. Sensitometric exposures (0.01 sec) were done using tungsten exposure with filtration to stimulate a daylight exposure. The described elements were processed for 3.25' in the known C-41 color process. The relative granularity at Dmin is given in grain units. Dye-layered emulsion without a surfactant added after the antenna dye relative to unlayered base finish exhibits increased Dmin, increased speed, increased Dmin granularity, and decreased gamma. A variety of anionic surfactants were evaluated because the surfactant properties of DOX-3 were thought to be important, in part, for its beneficial sensitometric effects. This table, shows a sensitometric comparison among several common and proprietary surfactants. The data suggest that several of the surfactants reduce Dmin from layering, but not nearly as

| Sample | | Sensitization | ΔDmin | Relative Granularity @ D min | Normalized Relative Sensitivity @ 0.15 D | ΔGamma |
|---|---|---|---|---|---|---|
| 1 | Comparison | None | −0.106 | −10.2 | 81 | 1.22 |
| 2 | Ref. | GSD-3 | 0 | 0 | 100 | −0.29 |
| 3 | Invention | GSD-3 + DOX-3 | −0.070 | −11.6 | 91 | −0.09 |
| 4 | Comparison | GSD-3 + DOX-16 | 0 | +0.8 | 100 | −0.31 |
| 5 | Comparison | GSD-3 + DOX-17 | −0.003 | +0.9 | 102 | −0.30 |
| 6 | Comparison | GSD-3 + DOX-18 | +0.013 | +1.9 | 100 | −0.30 |
| 7 | Comparison | GSD-3 + DOX-19 | +0.004 | −0.4 | 83 | −0.25 |
| 8 | Comparison | GSD-3 + DOX-20 | +0.050 | +5.1 | 102 | −0.43 |

Example 2

Film coating evaluations were carried out in color format on a sulfur-and-gold sensitized 1.62 μm×0.131 μm silver bromide tabular emulsion containing 4.5 mole % iodide. The emulsion was heated to 43° C. and sodium thiocyanate (100 mg/Ag mole) was added. After a 5' hold, 3-(2-methylsulfamoylethyl)-benzothiazolium tetrafluoroborate effectively as DOX-3. These same surfactants were effective for lowering granularity. They also provided near maximum speed from the increased absorption by the layered dye, whereas DOX-3 reduced the speed from layering with the amount used in this evaluation. One of these compounds, S-1, was chosen to use in current dye layering formulations.

| Sample | | Sensitization | ΔDmin | Relative Granularity @ D min | Normalized Relative Sensitivity @ 0.15 D | ΔGamma |
|---|---|---|---|---|---|---|
| 1 | Comparison | None | −0.106 | −10.5 | 81 | +0.29 |
| 2 | Ref. | GSD-3 | 0 | 0 | 100 | 0 |
| 3 | Invention | GSD-3 + DOX-3 | −0.070 | −11.9 | 91 | +0.20 |
| 4 | Invention | GSD-3 + S-1 | −0.054 | −5.2 | 102 | +0.12 |
| 5 | Invention | GSD-3 + S-10 | −0.052 | −5.7 | 100 | +0.11 |
| 6 | Invention | GSD-3 + S-11 | −0.026 | −3.2 | 93 | +0.11 |
| 7 | Invention | GSD-3 + S-16 | −0.036 | −3.6 | 100 | +0.11 |
| 8 | Invention | GSD-3 + S-13 | −0.036 | −3.3 | 100 | +0.08 |
| 9 | Comparison | GSD-3 + S-15 | +0.020 | +1.0 | 105 | −0.10 |

Example 3

Film coating evaluations were carried out in color format on a sulfur-and-gold sensitized 1.57 μm×0.129 μm silver bromide tabular emulsion containing 4.5 mole % iodide. The emulsion was heated to 43° C. and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye was added. After a 20' hold, the second sensitizing dye was added with a subsequent 20' hold. This was followed by the addition of 1-carboxymethyl-1,3,3-trimethyl-2-thiourea, sodium salt (2.28 mg/Ag mole). After a 2' hold, aurate (3-), bis[2-[[[3-[4,5-dihydro-5-(thioxo-S)-1H-tetrazol-1-yl]phenyl]amino]carbonyl]benzenesulfonato (2-)]-, tripotassium (4.04 mg/Ag mole) was added, followed by a 2' hold. The emulsion was held for 16' at 60° C. After cooling to 43° C., 1-(3-acetamidophenyl)-5-mercaptotetrazole (25 mg/Ag mole) was added with a subsequent hold for 2'. Then 1.2 mmole/Ag mole GSD-3 layering dye was added followed by a 30' hold. Next, DOX-3 was added at 1x or 2x (where x equals 4.3 mmole/Ag mole) followed by a 2' hold. This was followed with the addition of S-1 at 3.37 mmole/Ag mole and a 2' hold. Then, 4-hydroxy-6-methyl-1,3,3a,7-tetraazaindene, sodium salt, monohydrate, (1 g/Ag mole) was added and then held for 5'. The melt was subsequently chilled at 5° C. Before coating, the emulsion was combined with gelatin and distilled water to a concentration of 0.15 Ag mole/kg; and subsequently heated to 40° C. to mix components. Single-layer coatings were made on acetate support. Silver lay down was 807 mg/m$^2$ (75 mg/ft$^2$). The silver melt was combined with a coupler dispersion containing a magenta forming coupler MC-1 at a lay down of 226 mg/m$^2$ (21 mg/ft$^2$). Gelatin lay down was 3228 mg/m$^2$ (300 mg/ft$^2$). A hardened overcoat was at 2690 mg/m$^2$ (250 mg/ft$^2$) gelatin. Sensitometric exposures (0.01 sec) were done using tungsten exposure with filtration to stimulate a daylight exposure. The described elements were processed for 3.25' in the known C-41 color process. The relative granularity at Dmin is given in grain units. Dye-layered emulsion without DOX-3 and/or S-1 surfactant added after the antenna dye relative to unlayered base finish exhibits increased Dmin, increased speed, increased Dmin granularity, and decreased gamma. Acceptable Dmin and granularity values can be obtained with relatively high amounts DOX-3 (in combination with APMT and TAI), but at the expense of lower speed difference between the layered and unlayered emulsions. On the other hand, S-1 provided a way to maintain if not increase the speed from layering with better granularity than without DOX-3 or S-1, but did not lower Dmin as effectively as DOX-3. So, combinations of DOX-3 and S-1 were explored to determine whether lower amounts of DOX-3 could be used to achieve best performance. The subsequent table shows the sensitometric data from layered emulsions formulated with DOX-3, S-1, and a DOX-3/S-1 combination. The combination with a relatively low amount of DOX-3 maximized speed and minimized Dmin with lower granularity that either DOX-3 or S-1 added alone at the same amounts.

| Sample | | Sensitization | ΔDmin | Relative Granularity @ D min | Normalized Relative Sensitivity @ 0.15 D | ΔGamma |
|---|---|---|---|---|---|---|
| 1 | Comparison | 0 | −0.11 | −19.0 | 72 | +0.27 |
| 2 | Comparison | 1 × DOX-3 + 1y S-1 | −0.09 | −16.1 | 79 | +0.17 |
| 3 | Ref. | GSD-3 | 0 | 0 | 100 | 1.11 |
| 4 | Invention | GSD-3 + 2x DOX-3 | −0.06 | −12.7 | 96 | +0.20 |
| 5 | Invention | GSD-3 + 1x DOX-3 | −0.05 | −9.2 | 100 | +0.06 |
| 6 | Invention | GSD-3 + 1y S-1 | −0.05 | −7.7 | 105 | +0.07 |
| 7 | Invention | GSD-3 + 1x DOX-3 + 1y S-1 | −0.06 | −11.2 | 105 | +0.17 |

Example 4

Film coating evaluations were carried out in color format on a sulfur-and-gold sensitized 1.10 μm×0.115 μm silver bromide tabular emulsion containing 4.5 mole % iodide. The emulsion was heated to 43° C. and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye GSD-1 was added. After a 20' hold, the second sensitizing dye GSD-2 was added with a subsequent 20' hold. This was followed by the addition of sodium aurous dithiosulfate dihydrate (2.19 mg/Ag mole). After a 2' hold, sodium thiosulfate pentahydrate (1.0 mg/Ag mole) was added, followed by a 2' hold. The emulsion was held for 22' at 60° C. After cooling to 43° C., 4-hydroxy-6-methyl-1,3,3a,7-tetraazaindene, sodium salt, monohydrate, (1 g/Ag mole) was added and then held for 2'. This was followed by the addition of 1-(3-acetamidophenyl)-5-mercaptotetrazole (25 mg/Ag mole) and a subsequent hold for 2'. Then the GSD-3-Ms layering dye was added at 1.2 mmole/Ag mole, followed by a 30' hold. Next, an oxidized developer scavenger DOX-3 (see table) was added at increasing amounts from 0.5x to 2.0x (where x equals 4.3 mmole DOX-3/Ag mole), followed by a 5' hold. The melt was subsequently chilled at 5° C. Before coating, the emulsion was combined with gelatin and distilled water to a concentration of 0.15 Ag mole/kg; and subsequently heated to 40° C. to mix components. Single-layer coatings were made on acetate support. Silver lay down was 807 mg/m$^2$ (75 mg/ft$^2$). The silver melt was combined with a coupler dispersion containing a magenta forming coupler MC-1 at a lay down of 226 mg/m$^2$ (21 mg/ft$^2$). Gelatin lay down was 3228 mg/m$^2$ (300 mg/ft$^2$). A hardened overcoat was at 2690 mg/m$^2$ (250 mg/ft$^2$) gelatin. Sensitometric exposures (0.01 sec) were done using tungsten exposure with filtration to stimulate a daylight exposure. The described elements were processed for 3.25' in the known C-41 color process. The relative granularity at Dmin is given in grain units. Increasing DOX-3 amount provided lower Dmin and granularity, as well as reduced speed improvement by the layered dye.

| Example | | Sensitization | ΔDmin | Relative Granularity @ D min | Normalized Relative Sensitivity @ 0.15 D | ΔGamma |
|---|---|---|---|---|---|---|
| 1 | Comparison | 0 | −0.09 | −11.9 | 69 | +0.33 |
| 2 | Comparison | 1.0x DOX-3 | −0.10 | −15.1 | 65 | +0.44 |
| 3 | Ref. | GSD-3 | 0 | 0 | 100 | 0 |
| 4 | Invention | GSD-3 + 0.5x DOX-3 | −0.03 | −5.0 | 96 | +0.13 |
| 5 | Invention | GSD-3 + 1.0x DOX-3 | −0.05 | −9.7 | 91 | +0.17 |
| 6 | Invention | GSD-3 + 2.0x DOX-3 | −0.06 | −11.8 | 87 | +0.19 |

Example 5

Film coating evaluations were carried out in color format on a sulfur-and-gold sensitized 1.57 μm×0.129 μm silver bromide tabular emulsion containing 4.5 mole % iodide. The emulsion was heated to 43° C. and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye was added. After a 20' hold, the second sensitizing dye was added with a subsequent 20' hold. This was followed by the addition of 1-carboxymethyl-1,3,3-trimethyl-2-thiourea, sodium salt (2.28 mg/Ag mole). After a 2' hold, aurate(3-), bis[2-[[[3-[4,5-dihydro-5-(thioxo-S)-1H-tetrazol-1-yl]phenyl]amino]carbonyl]benzenesulfonato(2-)]-, tripotassium (4.04 mg/Ag mole) was added, followed by a 2' hold. The emulsion was held for 16' at 60° C. After cooling to 43° C., 1-(3-acetamidophenyl)-5-mercaptotetrazole (25 mg/Ag mole) was added with a subsequent hold for 2'. Then the GSD-3-Ms layering dye was added at 1.2 mmole/Ag mole, followed by a 30' hold. This was followed with the addition of S-1 at 1.0x, 1.5x, and 2.0x (where x equals 2.25 mmole S-1/Ag mole); and a 2' hold. Then, 4-hydroxy-6-methyl-1,3,3a,7-tetraazaindene, sodium salt, monohydrate, (1 g/Ag mole) was added and then held for 5'. The melt was subsequently chilled at 5° C. Before coating, the emulsion was combined with gelatin and distilled water to a concentration of 0.15 Ag mole/kg; and subsequently heated to 40° C. to mix components. Single-layer coatings were made on acetate support. Silver laydown was 807 mg/m$^2$ (75 mg/ft$^2$). The silver melt was combined with a coupler dispersion containing a magenta forming coupler MC-1 at a laydown of 226 mg/m$^2$ (21 mg/ft$^2$). Gelatin laydown was 3228 mg/m$^2$ (300 mg/ft$^2$). A hardened overcoat was at 2690 mg/m$^2$ (250 mg/ft$^2$) gelatin. Sensitometric exposures (0.01 sec) were done using tungsten exposure with filtration to stimulate a daylight exposure. The described elements were processed for 3.25' in the known C-41 color process. The relative granularity at Dmin is given in grain units. Increasing S-1 anionic surfactant amount provided lower Dmin and granularity, and maintained speed improvement by the layered dye.

| Example | | Sensitization | ΔDmin | Rel. Granularity @ D min | Normalized Relative Sensitivity @ 0.15 D | ΔGamma |
|---|---|---|---|---|---|---|
| 1 | Comparison | 0 | −0.11 | −18.6 | 72 | +0.14 |
| 3 | Ref | GSD-3 | 0 | 0 | 100 | 0 |
| 4 | Invention | GSD-3 + 1.0x S-1 | −0.05 | −6.4 | 105 | −0.02 |
| 5 | Invention | GSD-3 + 1.5x S-1 | −0.05 | −7.7 | 105 | +0.07 |
| 6 | Invention | GSD-3 + 2.0x S-1 | −0.05 | −6.8 | 105 | +0.07 |

Example 6a

Film-coating evaluations were carried out in a color format on a sulfur-and-gold sensitized 2.3×0.13 um silver bromide tabular emulsion containing 3.7 mole % iodide. The emulsion was heated to 43.3C and sodium thiocyanate (100 mg/Ag mole) was added. After a 10' hold, 3-(2-methylsulfamoylethyl)-benzothiazolium tetrafluoroborate (35 mg/Ag mole) was added followed by a 2' hold. The first green anionic sensitizing dye (GSD-1, 0.684 mM/Ag mole) was then added. After a 20' hold, the second green zwitterionic sensitizing dye (GSD-2, 0.172 mM/Ag mole) was added followed by a 20' hold. This was followed by the addition of sodium aurous dithiosulfate dihydrate (2.111 mg/Ag mole). After a 2' hold, sodium thiosulfate pentahydrate (0.995 mg/Ag mole) was added followed by a 2' hold. The emulsion was then heated to 60.0C and held for 21'. After cooling to 40C, 4-hydroxy-6-methyl-1,3,3a,7-tetraazaindene, sodium salt, monohydrate (0.50 g/Ag mole) was added followed by a 2' hold. Next, the green cationic antenna dye GSD-3 (1.20 mM/Ag mole) or GSD-4 (1.20 mM/Ag mole) was added followed by a 30' hold (Example 6a "Reference 1" and "Reference 2", respectively). Next, 1.5 gms S-1 surfactant (sodium di-2-ethyl-hexyl-sulfosuccinate)/mole and 0.5 gms sodium 2,5-dihydroxy-4-(1-methylheptadecyl)-benzenesulfonate (DOX-3)/mole were added sequentially each with a 5' hold, either before (Example 6a "Comparison 1" and "Comparison 2," respectively) or after the cationic antenna addition (Example 6a "Invention 1" and "Invention 2," respectively). Finally, gelatin and water were added to the emulsion melts at a concentration of 0.162 Ag mole/kg for coating. Single-layer coatings were made on acetate support. Silver laydown was 807 mg/m$^2$ (75 mg/ft$^2$). The silver melt was combined with a coupler dispersion containing a magenta-forming coupler MC-1 at a laydown of 215 mg/m$^2$ (20 mg/ft$^2$). The gelatin laydown was 3229 mg/m$^2$ (300 mg/ft$^2$). A hardened gelatin overcoat was then applied with a laydown of 2691 mg/m$^2$ (250 mg/ft$^2$). Sensitometric exposures (0.01 sec) were carried out using tungsten illumination with filtration to simulate a daylight exposure. The described elements were processed for 3.25' in the known C-41 color process. Adding the S-1 (S-1)/DOX-3 doctors BEFORE DYE LAYERING, eradicates the speed enhancement from the antenna dye. Adding the same levels of S-1/DOX-3 doctors AFTER DYE LAYERING improves Dmin, Dmin granularity, and gamma.

| Sample | | Addenda | Antenna Dye | ΔDmin | Rel. Granularity @ Dmin | Normalized Relative Sensitivity @ 0.15 D | ΔGamma |
|---|---|---|---|---|---|---|---|
| 1 | Reference 1 | None | GSD-3 | Ref 1 (0) | Ref 1 (0) | Ref 1 (100) | Ref 1 (0) |
| 2 | Comparison 1 | S-1 + DOX-3 | GSD-3 | −0.05 | −7.1 | 74 | 0.21 |
| 3 | Invention 1 | S-1 + DOX-3 | GSD-3 | −0.05 | −4.7 | 98 | 0.09 |
| 4 | Reference 2 | None | GSD-4 | Ref 2 (0) | Ref 2 (0) | Ref 2 (100) | Ref 2 (0) |
| 5 | Comparison 2 | S-1 + DOX-3 | GSD-4 | −0.03 | −4.7 | 72 | 0.11 |
| 6 | Invention 2 | S-1 + DOX-3 | GSD-4 | −0.02 | −3.9 | 100 | 0.04 |

Example 6b

Film-coating evaluations were carried out in a color format on a sulfur-and-gold sensitized 1.09×0.124 um silver bromide tabular emulsion containing 3.0 mole % iodide. The emulsion was heated to 43.3C and sodium thiocyanate (150 mg/Ag mole) was added. After a 10' hold, 3-(2-methylsulfamoylethyl)-benzothiazolium tetrafluoroborate (35 mg/Ag mole) was added followed by a 2' hold. The first green anionic sensitizing dye (GSD-1, 0.653 mM/Ag mole) was then added. After a 10' hold, the second green zwitterionic sensitizing dye (GSD-2, 0.173 mM/Ag mole) was added followed by a 20' hold. This was followed by the addition of sodium aurous dithiosulfate dihydrate (2.20 mg/Ag mole). After a 2' hold, sodium thiosulfate pentahydrate (1.03 mg/Ag mole) was added followed by a 2' hold. The emulsion was then heated to 62.5C and held for 16'. After cooling to 40C, 4-hydroxy-6-methyl-1,3,3a,7-tetraazaindene, sodium salt, monohydrate (0.50 g/Ag mole) was added followed by a 2' bold. Next, 1-(3-acetamidophenyl)-5-mercaptotetrazole (15 mg/Ag mole) was added followed by a 2' hold. Subsequently, the green cationic antenna dye GSD-3-Ms (1.20 mM/Ag mole) or GSD-4 (1.20 mM/Ag mole) was added followed by a 30' hold (Example 6b "Reference 1" and "Reference 2", respectively). Next, 1.5 gms. S-1 (S-1) surfactant (sodium di-2-ethyl-hexyl-sulfosuccinate)/mole and 0.5 gms. sodium 2,5-dihydroxy-4-(1-methylheptadecyl)-benzenesulfonate (DOX-3)/mole were added sequentially each with a 5' hold, either before (Example 6b "Comparison 1" and "Comparison 2," respectively) or after the cationic antenna addition (Example 6a "Invention 1" and "Invention 2," respectively). Finally, gelatin and water were added to the emulsion melts at a concentration of 0.216 Ag mole/kg for coating. Single-layer coatings were made on acetate support. Silver laydown was 807 mg/m2 (75 mg/ft$^2$). The silver melt was combined with a coupler dispersion containing a magenta-forming coupler MC-1 at a laydown of 215 mg/m$^2$ (20 mg/ft$^2$). The gelatin laydown was 3229 mg/M$^2$ (300 mg/ft$^2$). A hardened gelatin overcoat was then applied with a laydown of 2691 mg/m$^2$ (250 mg/ft$^2$). Sensitometric exposures (0.01 sec) were carried out using tungsten illumination with filtration to simulate a daylight exposure. The described elements were processed for 3.25' in the known C-41 color process. Adding the S-1/DOX-3 doctors BEFORE DYE LAYERING, eradicates the speed enhancement from the antenna dye. Adding the same levels of S-1/DOX-3 doctors AFTER DYE LAYERING improves Dmin, Dmin granularity, and gamma.

| Sample | | Addenda | Antenna Dye | ΔDmin | Rel. Granularity @ Dmin | Normalized Relative Sensitivity @ 0.15 D | ΔGamma |
|---|---|---|---|---|---|---|---|
| 1 | Reference 1 | None | GSD-3 | Ref 1 (0) | Ref 1 (0) | Ref 1 (100) | Ref 1 (0) |
| 2 | Comparison 1 | S-1 + DOX-3 | GSD-3 | −0.13 | −9.2 | 72 | 0.21 |
| 3 | Invention 1 | S-1 + DOX-3 | GSD-3 | −0.12 | −6.5 | 102 | 0.14 |

-continued

| Sample | | Addenda | Antenna Dye | ΔDmin | Rel. Granularity @ Dmin | Normalized Relative Sensitivity @ 0.15 D | ΔGamma |
|---|---|---|---|---|---|---|---|
| 4 | Reference 2 | None | GSD-4 | Ref 2 (0) | Ref 2 (0) | Ref 2 (100) | Ref 2 (0) |
| 5 | Comparison 2 | S-1 + DOX-3 | GSD-4 | −0.08 | −8.6 | 74 | 0.14 |
| 6 | Invention 2 | S-1 + DOX-3 | GSD-4 | −0.05 | −5.9 | 100 | 0.11 |

Example 7

Film-coating evaluations were carried out in a color format on a sulfur-and-gold sensitized 1.09×0.124 μm silver bromide tabular emulsion containing 3.0 mole % iodide. The emulsion was heated to 43.3C and sodium thiocyanate (150 mg/Ag mole) was added. After a 10' hold, 3-(2-methylsulfamoylethyl)-benzothiazolium tetrafluoroborate (35 mg/Ag mole) was added followed by a 2' hold. The first green anionic sensitizing dye (GSD-1, 0.653 mM/Ag mole) was then added. After a 10' hold, the second green zwitterionic sensitizing dye (GSD-2, 0.173 mM/Ag mole) was added followed by a 20' hold. This was followed by the addition of sodium aurous dithiosulfate dihydrate (2.20 mg/Ag mole). After a 2' hold, sodium thiosulfate pentahydrate (1.03 mg/Ag mole) was added followed by a 2' hold. The emulsion was then heated to 62.5C and held for 16'. After cooling to 40C, 4-hydroxy-6-methyl-1,3,3a,7-tetraazaindene, sodium salt, monohydrate (0.50 g/Ag mole) was added followed by a 2' hold. Next, 1-(3-acetamidophenyl)-5-mercaptotetrazole (15 mg/Ag mole) was added followed by a 2' hold. Subsequently, the green cationic antenna dye GSD-4 (1.20 mM/Ag mole) was added followed by a 30' hold ("Reference"). Next, 4.448 mmole/Ag-mole surfactant was added to the melt followed by a 5' hold ("Comparison" or "Invention"). Finally, gelatin and water were added to the emulsion melts at a concentration of 0.162 Ag mole/kg for coating. Single-layer coatings were made on acetate support. Silver laydown was 807 mg/m$^2$ (75 mg/ft$^2$). The silver melt was combined with a coupler dispersion containing a magenta-forming coupler MC-1 at a laydown of 215 mg/m$^2$ (20 mg/ft$^2$). The gelatin laydown was 3229 mg/m$^2$ (300 mg/ft$^2$). A hardened gelatin overcoat was then applied with a laydown of 2691 mg/m$^2$ (250 mg/ft$^2$). Sensitometric exposures (0.01 sec) were carried out using tungsten illumination with filtration to simulate a daylight exposure. The described elements were processed for 3.25' in the known C-41 color process. Dye-layered emulsion (without Dox scavenger and/or surfactant added) relative to unlayered base finish exhibits increased Dmin, increased speed, increased Dmin granularity, and lowered gamma. When added alone (without Dox scavenger) at equimolar levels the anionic surfactants gave the best overall performance in terms of Dmin, contrast, net speed enhancement from the antenna dye and grain. When added alone (without Dox scavenger) at equimolar surfactant levels S-1 gave the best overall performance.

| Sample | | Surfactant | Surfactant Type | ΔDmin | Rel. Granularity @ Dmin | Normalized Relative Sensitivity @ 0.15 D | ΔGamma |
|---|---|---|---|---|---|---|---|
| 1 | Reference | NONE | — | Ref (0) | Ref (0) | Ref (100) | Ref (0) |
| 2 | Invention | S-1 | Anionic | −0.050 | −3.3 | 107 | 0.11 |
| 3 | Invention | S-2 | Anionic | −0.037 | −2.4 | 107 | 0.08 |
| 4 | Invention | S-10 | Anionic | −0.035 | −1.7 | 105 | 0.09 |
| S | Invention | S-11 | Anionic | −0.024 | −1.6 | 107 | 0.05 |
| 6 | Invention | S-13 | Anionic | −0.030 | −0.7 | 107 | 0.10 |
| 7 | Invention | S-17 | Nonionic | −0.033 | −1.8 | 100 | 0.01 |
| 8 | Invention | S-19 | Nonionic | −0.030 | −2.5 | 96 | −0.07 |
| 9 | Comparison | S-23 | Cationic | 0.007 | −3.7 | 81 | −0.16 |
| 10 | Comparison | S-25 | Cationic | 0.011 | −7.4 | 50 | −0.13 |

The data below clearly show that the most preferred anionic surfactants in example 7 have been added to the dye-layered emulsion at concentrations within the respective range of $10^{-1}$ times the CAC and [CAC+30% (CMC2-CAC].

| Example | Anionic Surfactant | CAC (mol/kg) | Surfactant Conc (mol/kg) | [CAC + 30% (CMC2 − CAC)] |
|---|---|---|---|---|
| 7.2 | S-1 | $1.3 \times 10^{-4}$ | $7.22 \times 10^{-4}$ | $>2.10 \times 10^{-3}$ |
| 7.3 | S-2 | $6.2 \times 10^{-4}$ | $7.22 \times 10^{-4}$ | $>2.29 \times 10^{-3}$ |
| 7.4 | S-10 | $2.3 \times 10^{-4}$ | $7.22 \times 10^{-4}$ | $>3.16 \times 10^{-3}$ |
| 7.6 | S-13 | $1.7 \times 10^{-3}$ | $7.22 \times 10^{-4}$ | $>3.71 \times 10^{-3}$ |

| | |
|---|---|
| S-23 | $CH_3(CH_2)_{11}N(CH_3)_3Br$ |
| S-24 | $[CH_3(CH_2)_{11}]_2N(CH_3)_2Br$ |
| S-25 | $CH_3(CH_2)_{15}N(CH_3)_3Br$ |
| S-26 | $CH_3(CH_2)_{17}N(CH_3)_3Br$ |
| S-27 | $H(EO)_y[R]N(CH_3)(EO)_xHCl$ where $(EO)_{x+y=15}$, $R=C_{10}$, $C_{12}$, $C_{14}$ |

Example 8

Film-coating evaluations were carried out in a color format on a sulfur-and-gold sensitized 1.09×0.124 μm silver bromide tabular emulsion containing 3.0 mole % iodide. The emulsion was heated to 43.3C and sodium thiocyanate (150 mg/Ag mole) was added. After a 10' hold, 3-(2-methylsulfamoylethyl)-benzothiazolium tetrafluoroborate (35 mg/Ag mole) was added followed by a 2' hold. The first green anionic sensitizing dye (GSD-1, 0.653 mM/Ag mole) was then added. After a 10' hold, the second green zwitterionic sensitizing dye (GSD-2, 0.173 mM/Ag mole) was added followed by a 20' hold. This was followed by the addition of sodium aurous dithiosulfate dihydrate (2.20 mg/Ag mole). After a 2' hold, sodium thiosulfate pentahydrate (1.03 mg/Ag mole) was added followed by a 2' hold. The emulsion was then heated to 62.5C and held for 16'. After cooling to 40C, 4-hydroxy-6-methyl-1,3,3a,7-tetraazaindene, sodium salt, monohydrate (0.50 g/Ag mole) was added followed by a 2' hold. Next, 1-(3-acetamidophenyl)-5-mercaptotetrazole (15 mg/Ag mole) was added followed by a 2' hold ("Reference"). Subsequently, the green cationic antenna dye GSD-4 (1.20 mM/Ag mole) was added followed by a 30' hold. Next, 4.448 mmole sodium 2,5-dihydroxy-4-(1-methylheptadecyl)-benzenesulfonate (DOX-3)/Ag-mole ("Comparison A") or 4.448 mmole/Ag-mole of various surfactant types ("Invention" or "Comparison B") were added to the melt followed by a 10' hold. Finally, gelatin and water were added to the emulsion melts at a concentration of 0.162 Ag mole/kg for coating. Single-layer coatings were made on acetate support. Silver laydown was 807 mg/m2 (75 mg/ft$^2$). The silver melt was combined with a coupler dispersion containing a magenta-forming coupler MC-1 at a laydown of 215 mg/m2 (20 mg/ft2). The gelatin laydown was 3229 mg/m2 (300 mg/ft2). A hardened gelatin overcoat was then applied with a laydown of 2691 mg/m2 (250 mg/ft2). Sensitometric exposures (0.01 sec) were carried out using tungsten illumination with filtration to simulate a daylight exposure. The described elements were processed for 3.25' in the known C-41 color process. This example compares the effects of adding surfactants at equimolar levels of the following types: (a) anionic, containing single-chain, double-chain (S-1 and similar) and tri-chain surfactants; (b) nonionic (ethoxylated) S-17 through S-22 surfactants; (c) cationic, containing single-chain, double-chain and an ethoxylated cationic. In general, anionic surfactants as a class are better than nonionics and cationics for controlling Dmin, Dmin-grain, contrast and maximizing the net speed enhancement from the antenna dye. Certain structural types appear to be better (for the limited range of structures studied) within the anionic class of surfactants: (a) double-chain surfactants (like S-1) produce lowest Dmin and overall grain and highest contrast, (b) tri-chain surfactants are slightly inferior to double-chain surfactants but generally better than single-chain surfactants, and (c) ethoxylated single-chain anionic surfactant, S-15 appears to produce the largest net speed gain from the antenna dye, though at the expense of elevated Dmin-grain relative to the best anionic surfactants. In general, the nonionic (ethylene oxide) S-17 through S-22 surfactant class are ineffectual at controlling Dmin and Dmin-grain increases resulting from dye layering. In general, quaternary ammonium cationic surfactants did not work because (a) they significantly reduced the net speed gain furnished by the antenna dye, (b) they were ineffectual at lowering the Dmin of a dye-layered emulsion, (c) they resulted in a poor granularity position, and (d) they caused a significant contrast reduction.

| Sample | | Surfactant | Surfactant Type | ΔDmin | Rel. Granularity @ Dmin | Normalized Relative Sensitivity @ 0.15 D | ΔGamma |
|---|---|---|---|---|---|---|---|
| 1 | Reference | NONE | – | Ret (0) | Ref (0) | Ref (100) | Ref (0) |
| 2 | Comparison A | NONE | – | 0.025 | 2.1 | 120 | −0.08 |
| 3 | Invention | S-2 | Anionic | 0.011 | −0.5 | 135 | −0.15 |
| 4 | Invention | S-3 | Anionic | 0.012 | 0.0 | 138 | −0.15 |
| 5 | Invention | S-4 | Anionic | 0.018 | 2.4 | 141 | −0.19 |
| 6 | Invention | S-5 | Anionic | 0.038 | 5.1 | 138 | −0.22 |
| 7 | Invention | S-6 | Anionic | 0.035 | 6.1 | 141 | −0.23 |
| 8 | Invention | S-7 | Anionic | 0.019 | 2.6 | 138 | −0.19 |
| 9 | Invention | S-8 | Anionic | 0.041 | 7.1 | 138 | −0.21 |
| 10 | Invention | S-9 | Anionic | 0.025 | 5.0 | 141 | −0.22 |
| 11 | Invention | S-10 | Anionic | 0.031 | 5.2 | 135 | −0.23 |
| 12 | Invention | S-11 | Anionic | 0.069 | 10.0 | 132 | −0.26 |
| 13 | Invention | S-12 | Anionic | 0.102 | 13.6 | 129 | −0.29 |
| 14 | Invention | S-13 | Anionic | 0.048 | 7.9 | 138 | −0.23 |
| 15 | Invention | S-15 | Ethoxylated Anionic | 0.060 | 8.6 | 148 | −0.36 |
| 16 | Invention | S-16 | Ethoxylated Anionic | 0.033 | 6.0 | 138 | −0.25 |
| 17 | Invention | S-17 | Nonionic | 0.055 | 8.1 | 132 | −0.28 |
| 18 | Invention | S-18 | Nonionic | 0.087 | 11.2 | 132 | −0.30 |
| 19 | Invention | S-19 | Nonionic | 0.073 | 7.6 | 123 | −0.41 |
| 20 | Invention | S-20 | Nonionic | 0.027 | 0.4 | 123 | −0.41 |
| 21 | Invention | S-21 | Nonionic | 0.061 | 6.5 | 132 | −0.30 |
| 22 | Invention | S-22 | Nonionic | 0.074 | 8.7 | 132 | −0.30 |
| 23 | Comparison B | S-25 | Cationic | 0.059 | 6.8 | 102 | −0.38 |
| 24 | Comparison B | S-24 | Cationic | 0.556 | 5.9 | 1 | −1.08 |
| 25 | Comparison B | S-25 | Cationic | 0.067 | 1.1 | 69 | −0.39 |
| 26 | Comparison B | S-26 | Cationic | 0.185 | 7.3 | 42 | −0.59 |
| 27 | Comparison B | S-27 | Ethoxylated Cationic | 0.092 | 6.0 | 76 | −0.60 |

Example 9

Film-coating evaluations were carried out in a color format on a sulfur-and-gold sensitized 1.09×0.124 μm silver bromide tabular emulsion containing 3.0 mole % iodide. The emulsion was heated to 43.3C and sodium thiocyanate (150 mg/Ag mole) was added. After a 10' hold, 3-(2-melhylsulfamoylethyl)-benzothiazolium tetrafluoroborate (35 mg/Ag mole) was added followed by a 2' hold. The first green anionic sensitizing dye (GSD-1, 0.653 mM/Ag mole) was then added. After a 10' hold, the second green zwitterionic sensitizing dye (GSD-2, 0.173 mM/Ag mole) was added followed by a 20' hold. This was followed by the addition of sodium aurous dithiosulfate dihydrate (2.20 mg/Ag mole). After a 2' hold, sodium thiosulfate pentahydrate (1.03 mg/Ag mole) was added followed by a 2' hold. The emulsion was then heated to 62.5C and held for 16'. After cooling to 40C, 4-hydroxy-6-methyl-1,3,3a,7-tetraazaindene, sodium salt, monohydrate (0.50 g/Ag mole) was added followed by a 2' hold. Next, 1-(3-acetamidophenyl)-5-mercaptotetrazole (15 mg/Ag mole) was added followed by a 2' hold. Subsequently, the green cationic antenna dye GSD-4 (1.20 mM/Ag mole) was added followed by a 30' hold ("Reference"). Next, 3.374 mmole surfactant/Ag-mole followed by 1.074 mmole sodium 2,5-dihydroxy-4-(1-methylheptadecyl)-benzenesulfonate (DOX-3)/Ag-mole were added to the melt, each with a 10' hold ("Comparison" or "Invention"). Finally, gelatin and water were added to the emulsion melts at a concentration of 0.162 Ag mole/kg for coating. Single-layer coatings were made on acetate support. Silver laydown was 807 mg/m2 (75 mg/ft2). The silver melt was combined with a coupler dispersion containing a magenta-forming coupler MC-1 at a laydown of 215 mg/m2 (20 mg/ft2). The gelatin laydown was 3229 mg/m2 (300 mg/ft2). A hardened gelatin overcoat was then applied with a laydown of 2691 mg/m2 (250 mg/ft2). Sensitometric exposures (0.01 sec) were carried out using tungsten illumination with filtration to simulate a daylight exposure. The described elements were processed for 3.25' in the known C-41 color process. When the various surfactants (all at equimolar levels) were combined with DOX-3 (added at an equimolar level) a lowering of both Dmin and Dmin-grain was realized at the expense of minimal speed loss for all anionic and nonionic surfactants. S-1 (the best surfactant when used alone) when combined with DOX-3 gave an overall better performance, with lower Dmin and Dmin-grain, than S-1 used alone (at the same total molar levels) or any other surfactant used alone or in combination with DOX-3. When added to a dye-layered emulsion at the same optimal level as the best overall surfactant (S-1), cationic surfactants with or without DOX-3 gave inferior performance causing speed and contrast losses and granularity degradation.

| Sample | | Surfactant | Surfactant Type | ΔDmin | Rel. Granularity @ Dmin | Normalized Relative Sensitivity @ 0.15 D | ΔGamma |
|---|---|---|---|---|---|---|---|
| 1 | Reference | NONE | – | Ref (0) | Ref (0) | Ref (100) | Ref (0) |
| 2 | Invention | S-1 | Anionic | −0.064 | −5.8 | 105 | 0.16 |
| 3 | Invention | S-2 | Anionic | −0.059 | −5.0 | 105 | 0.16 |
| 4 | Invention | S-10 | Anionic | −0.056 | −3.8 | 102 | 0.11 |
| 5 | Invention | S-11 | Anionic | −0.056 | −3.8 | 105 | 0.10 |
| 6 | Invention | S-13 | Anionic | −0.047 | −3.0 | 105 | 0.14 |
| 7 | | S-17 | Nonionic | −0.035 | −3.1 | 100 | 0.03 |
| 8 | | S-19 | Nonionic | −0.059 | −5.5 | 93 | 0.04 |
| 9 | Comparison | S-23 | Cationic | 0.047 | −2.6 | 76 | −0.16 |
| 10 | Comparison | S-25 | Cationic | −0.025 | −9.0 | 65 | −0.04 |
| 11 | Comparison | NONE | – | −0.007 | −5.4 | 85 | 0.09 |

Example 10

Film-coating evaluations were carried out in a color format on a sulfur-and-gold sensitized 1.09×0.124 um silver bromide tabular emulsion containing 3.0 mole % iodide. The emulsion was heated to 43.3C and sodium thiocyanate (150 mg/Ag mole) was added. After a 10' hold, 3-(2-methylsulfamoylethyl)-benzothiazolium tetrafluoroborate (35 mg/Ag mole) was added followed by a 2' hold. The first green anionic sensitizing dye (GSD-1, 0.653 mM/Ag mole) was then added. After a 10' hold, the second green zwitterionic sensitizing dye (GSD-2, 0.173 mM/Ag mole) was added followed by a 20' hold. This was followed by the addition of sodium aurous dithiosulfate dihydrate (2.20 mg/Ag mole). After a 2' hold, sodium thiosulfate pentahydrate (1.03 mg/Ag mole) was added followed by a 2' hold. The emulsion was then heated to 62.5C and held for 16'. After cooling to 40C, 4-hydroxy-6-methyl-1,3,3a,7-tetraazaindene, sodium salt, monohydrate (0.50 g/Ag mole) was added followed by a 2' hold. Next, 1-(3-acetamidophenyl)-5-mercaptotetrazole (15 mg/Ag mole) was added followed by a 2' hold. Subsequently, the green cationic antenna dye GSD-4 (1.20 mM/Ag mole) was added followed by a 30' hold ("Reference"). Next, 3.374 mmole/Ag-mole sodium di-2-ethyl-hexyl-sulfosuccinate (S-1) and 1.074 mmole/Ag-mole sodium 2,5-dihydroxy-4-(1-methylheptadecyl)-benzenesulfonate (DOX-3) were added sequentially to the melt, each with a 10' hold ("Comparison" or "Invention"). Finally, gelatin and water were added to the emulsion melts at a concentration of 0.162 Ag mole/kg for coating. Single-layer coatings were made on acetate support. Silver laydown was 807 mg/m2 (75 mg/ft2). The silver melt was combined with a coupler dispersion containing a magenta-forming coupler MC-1 at a laydown of 215 mg/m2 (20 mg/ft2). The gelatin laydown was 3229 mg/m2 (300 mg/ft2). A hardened gelatin overcoat was then applied with a laydown of 2691 mg/m2 (250 mg/ft2). Sensitometric exposures (0.01 sec) were carried out using tungsten illumination with filtration to simulate a daylight exposure. The described elements were processed for 3.25' in the known C-41 color process. Dye-layered emulsion with S-1 surfactant+DOX-3 Dox scavenger exhibits (relative to dye-layered emulsion without): (a) lower Dmin (still higher than unlayered base finish largely because of elevated dye stain from GSD-4 dye), (b) lower Dmin granularity, and (c) higher contrast. Dye-layered emulsion with S-1+DOX-10 exhibits: (a) lower Dmin, (b) lower Dmin-granularity, and (c) higher contrast. Dye-layered emulsion in combination with S-1+ non-ballasted cationic Dox scavengers DOX-21 and DOX-22 exhibit gross speed loss. Dye-layered emulsion with S-1+DOX-3 behaves similarly to dye-layered emulsion with S-1+DOX-12. Dye-layered emulsion with S-1+DOX-2 (nonionic, ballasted, direct dispersion) performs similarly to equimolar S-1+DOX-3. Dye-layered emulsion with S-1+ DOX-1 (nonionic, ballasted, SOL-1 dispersion) exhibits significant speed loss. Ballasted anionic (sulphonated) Dox scavenger DOX-3, added to dye-layered emulsion after S-1 behaves similarly to non-ballasted analogues, DOX-16 and DOX-18. Dye-layered emulsion with S-1+DOX-3-like Dox scavengers added perform better than dye-layered emulsion with S-1+DOX-5 (and anionic analogues).

SOL-1 Phosphoric acid, tris(methylphenyl) ester mM/Ag mole) was added followed by a 30' hold. Next, S-1 was added to the melt followed by a 10' hold (Example I "Reference"). Next, a oxidized-developer scavenger was added to the melt followed by a 5' hold (Example I "Invention"). Finally, gelatin and water were added to the emulsion melts at a concentration of 0.181 Ag mole/kg for coating. Single-layer coatings were made on acetate support. Silver laydown was 883 mg/m2 (82 mg/ft2). The silver melt was combined with a coupler dispersion containing a magenta-forming coupler MC-1 at a laydown of 226 mg/m2 (21 mg/ft2), a yellow-coloured magenta masking coupler MM-1 at a laydown of 112 mg/m2 (10.4 mg/ft2), a yellow-coloured development-inhibitor-releasing compound YD-1 at a laydown of 27 mg/m2 (2.5 mg/ft2) and a universal, colourless development-inhibitor-releasing compound at a

| Sample | | Dox Scavenger | Dox Scavenger Type | Dox Scavenger Solvent | ΔDmin | Rel. Granularity @ Dmin | Normalized Relative Sensitivity @ 0.15 D | ΔGamma |
|---|---|---|---|---|---|---|---|---|
| 1 | Reference | NONE | – | – | Ref (0) | Ref (0) | Ref (100) | Ref (0) |
| 2 | Invention | DOX-3 | Anonic | $H_2O$ | −0.12 | −5.1 | 112 | 0.16 |
| 3 | Invention | DOX-10 | Anionic | SOL-2 | −0.18 | −13.1 | 105 | 0.29 |
| 4 | Invention | DOX-11 | Nonionic | SOL-2 | −0.15 | −8.1 | 107 | 0.25 |
| 5 | Invention | DOX-16 | Anionic | $H_2O$ | −0.10 | −2.7 | 115 | 0.10 |
| 6 | Invention | DOX-18 | Anionic | $H_2O$ | −0.12 | −4.6 | 110 | 0.14 |
| 7 | Invention | DOX-12 | Cationic | $H_2O$ | −0.13 | −4.9 | 110 | 0.15 |
| 8 | Comparison | DOX-21 | Cationic | $H_2O$ | −0.09 | −0.3 | 78 | 0.13 |
| 9 | Comparison | DOX-22 | Cationic | $H_2O$ | −0.11 | −7.5 | 59 | 0.24 |
| 10 | Invention | DOX-2 | Nonionic | NONE | −0.14 | −4.7 | 112 | 0.16 |
| 11 | Invention | DOX-13 | Anionic | $H_2O$ | −0.09 | −0.7 | 112 | 0.08 |
| 12 | Invention | DOX-14 | Di-anionic | $H_2O$ | −0.09 | −2.2 | 115 | 0.10 |
| 13 | Invention | DOX-5 | Nonionic | SOL-1 | −0.11 | −3.5 | 110 | 0.10 |

SOL-2 N,N-diethyl-Dodecanamide.

Example 11

Film-coating evaluations were carried out in a color format on a sulfur-and-gold sensitized 1.38×0.125 um silver bromide tabular emulsion containing 3.7 mole % iodide. The emulsion was heated to 43.3C and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. The first green anionic sensitizing dye (GSD-1, 0.761 mM/Ag mole) was then added. After a 20' hold, the second green zwitterionic sensitizing dye (GSD-2, 0.189 mM/Ag mole) was added followed by a 20' hold. This was followed by the addition of sodium aurous dithiosulfate dihydrate (2.00 mg/Ag mole). After a 2' hold sodium thiosulfate pentahydrate (1.00 mg/Ag mole) was added followed by a 2' hold. The emulsion was then heated to 61.7C and held for 17'. After cooling to 40C, 4-hydroxy-6-methyl-1,3,3a,7-tetraazaindene, sodium salt, monohydrate (0.50 g/Ag mole) was added followed by a 2' hold (Example I "Comparison"). Subsequently, the green cationic antenna dye GSD-4 (1.20 laydown of 16 mg/m2 (1.5 mg/ft2). The gelatin laydown was 3229 mg/m2 (300 mg/ft2). A hardened gelatin overcoat was then applied with a laydown of 2691 mg/m2 (250 mg/ft2). Sensitometric exposures (0.01 sec) were carried out using tungsten illumination with filtration to simulate a daylight exposure. The described elements were processed for 3.25' in the known C-41 color process. When added to a dye-layered emulsion in combination with an optimal level of S-1 anionic surfactant all Dox scavengers reduced the level of granularity at Dmin. The permanent solvent-dispersed carboxy-DOX-3 compounds (DOX-10 and DOX-15) appear to be more effective at reducing Dmin and certainly Dmin-granularity (DOX-15 most effective) compared to DOX-3 added at the same molar level, though at the expense of some speed. The permanent solvent-dispersed DOX-10) is more effective at reducing Dmin and certainly Dmin-granularity compared to DOX-3, DOX-2 (KS-dispersed) and DOX-1 (KS-dispersed) added at the same molar level of 1.076 mM/AgM, though at the expense of some speed.

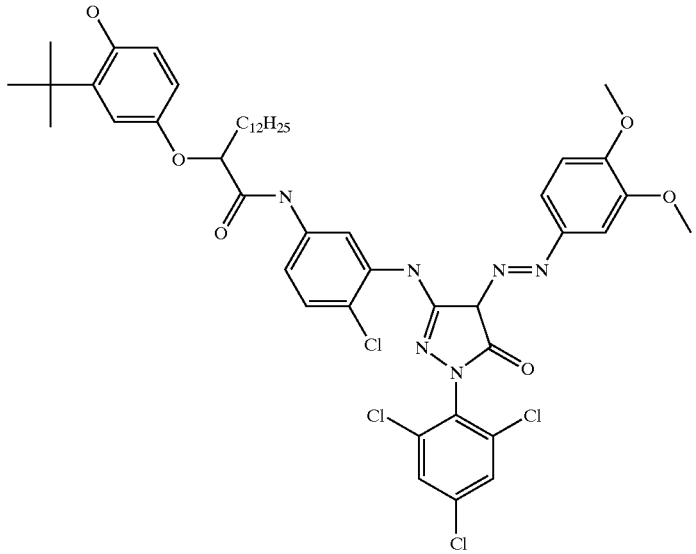

MM-1

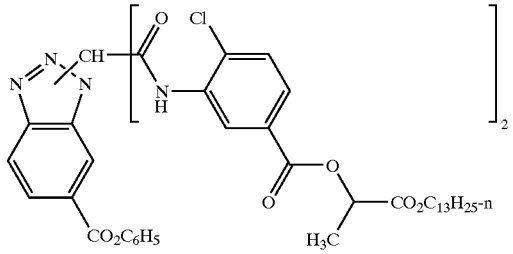

YD-1

| Sample | | Dox Scavenger | Conc (mM/AgM) | Dox Scavenger Type | Dox Scavenger Solvent | Δ DMIN | ΔGR @ DMIN | Δ SPDRN015 | Δ GAMMA |
|---|---|---|---|---|---|---|---|---|---|
| 1 | Ref | NONE | 0 | — | | Ref (0) | Ref (0) | Ref (100) | Ref (0) |
| 2 | Invent | DOX-10 | 1.076 | Anionic | SOL-2 | −0.02 | −5.5 | 96 | 0.13 |
| 3 | Invent | DOX-10 | 0.538 | Anionic | SOL-2 | −0.01 | −2.8 | 93 | 0.11 |
| 4 | Invent | DOX-15 | 0.538 | Anionic | SOL-1 | −0.01 | −5.5 | 93 | 0.09 |
| 6 | Invent | DOX-3 | 1.076 | Anionic | $H_2O$ | −0.01 | −1.9 | 98 | 0.05 |
| 7 | Invent | DOX-3 | 0.538 | Anionic | $H_2O$ | 0.00 | −1.2 | 102 | 0.00 |
| 8 | Invent | DOX-2 | 1.076 | Nonionic | NONE | −0.02 | −3.0 | 100 | 0.07 |

Example 12

Film-coating evaluations were carried out in a color format on a sulfur-and-gold sensitized 4.06×0.127 μm silver bromide tabular emulsion containing 3.7 mole % iodide. The emulsion was heated to 43.3C and sodium thiocyanate (100 mg/Ag mole) was added. After a 10' hold, 3-(2-methylsulfamoylethyl)-benzothiazolium tetrafluoroborate (25 mg/Ag mole) was added followed by a 2' hold. The first red anionic sensitizing dye (RSD-1, 0.041 mM/Ag mole) was then added. After a 5' hold, the second red anionic sensitizing dye (RSD-2, 0.111 mM/Ag mole) was added followed by a 15' hold. A third red anionic sensitizing dye (RSD-3, 0.662 mM/Ag mole) was then added followed by a 20' hold. This was followed by the addition of sodium aurous dithiosulfate dihydrate (1.646 mg/Ag mole). After a 2' hold, sodium thiosulfate pentahydrate (0.756 mg/Ag mole) was added followed by a 2' hold. The emulsion was then heated to 60.0C and held for 15'. After cooling to 40C, 4-hydroxy-6-methyl-1,3,3a,7-tetraazaindene, sodium salt, monohydrate (1.0 g/Ag mole) was added followed by a 2' hold. Next, 1-(3-acetamidophenyl)-5-mercaptotetrazole (23 mg/Ag mole) was added followed by a 5' hold ("Comparison"). Subsequently, the red cationic antenna dye (RSD-4, 1.25 mM/Ag mole) was added followed by a 30' hold ("Reference"). Next, 0.5 gms/Ag-mole sodium 2,5-dihydroxy-4-(1-methylheptadecyl)-benzenesulfonate (DOX-3) or 1.5 gms/Ag-mole anionic surfactant were added either alone with a 5' hold, or in combination (sequentially) each with 5' holds ("Invention"). Finally, gelatin and water were added to the emulsion melts at a concentration of 0.216 Ag mole/kg for coating. Single-layer coatings were made on acetate support. Silver laydown was 1076 mg/m2 (100 mg/ft2). The silver melt was combined with a coupler dispersion containing a cyan-forming coupler CC-1 at a laydown of 323 mg/m2 (30 mg/ft2). The gelatin laydown was 3229 mg/m2 (300 mg/ft2). A hardened gelatin overcoat was then applied with a laydown of 2691 mg/m2 (250 mg/ft2). Sensitometric exposures (0.01 sec) were carried out using tungsten illumination with filtration to simulate a daylight exposure. The described elements were processed for 3.25' in the known C-41 color process. Dye-layered emulsion with 1.25 mM/AgM RSD-4 (monocationic) antenna dye exhibits: (a) speed increase relative to unlayered PFC-1630 base finish, (b) elevated Dmin and Dmin-granularity, and (c) lower contrast and speed enhancement. Dye-layered emulsion with anionic surfactant, added at 1.5 gms/Ag-mole, exhibits (a) lower Dmin, (b) lower Dmin-granularity, and (c) higher speed and contrast. In general, all anionic surfactants furnish some performance improvements for dye-layered emulsion (Dmin, Dmin-granularity, speed, contrast). The surfactants furnishing the best overall performance improvements for dye-layered emulsion are di-chain (e.g. S-1 and proprietary S-1-like surfactants) and tri-chain surfactants.

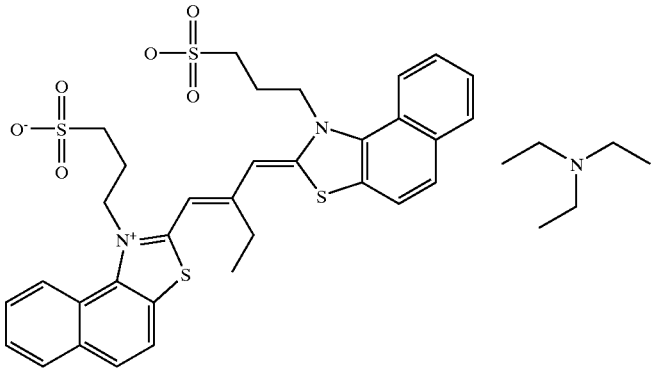

RSD-1

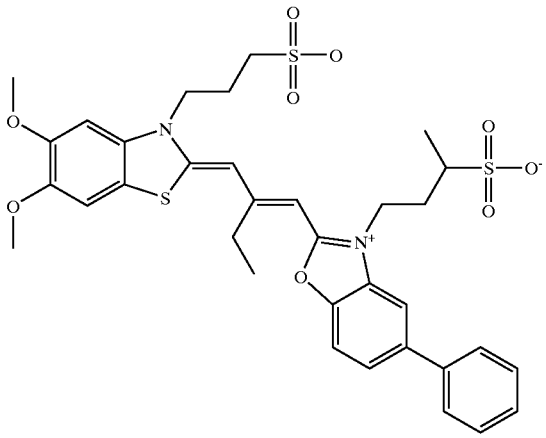

RSD-2

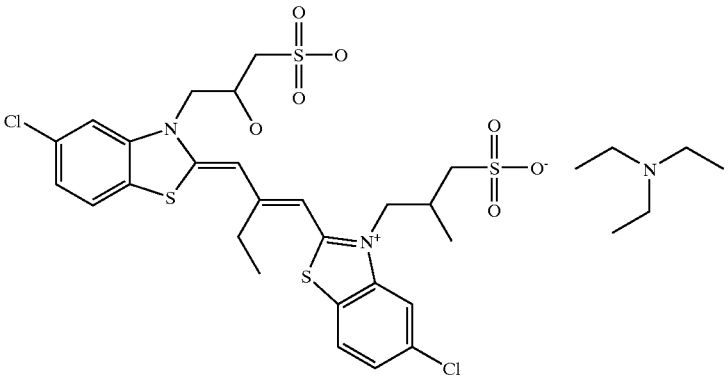

RSD-3

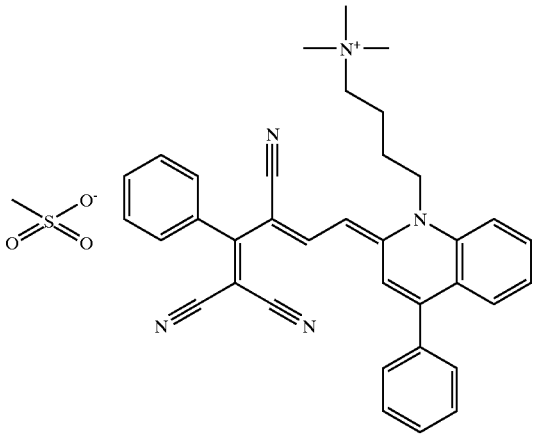

RSD-4

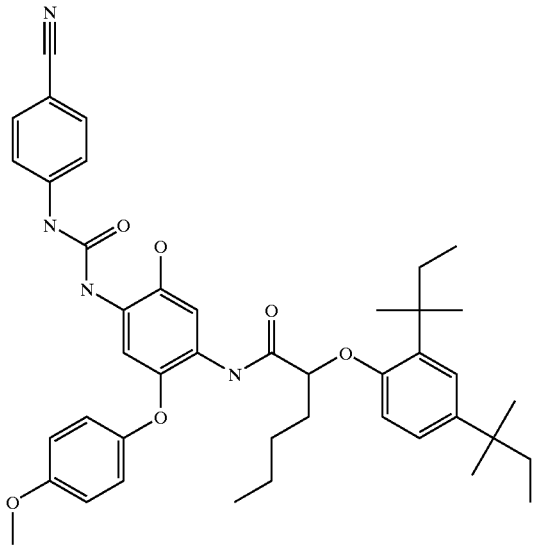

CC-1

| Sample | | Surfactant | DOX-3 | ΔDmin | Rel. Granularity @ Dmin | Normalized Relative Sensitivity @ 0.15 D | ΔGamma |
|---|---|---|---|---|---|---|---|
| 1 | Reference | NONE | 0 | Ref (0) | Ref (0) | Ref (100) | Ref (0) |
| 2 | Comparison | NONE | 0 | −0.13 | −6.1 | 91 | 0.17 |
| 3 | Invention | NONE | 500 | −0.03 | −5.7 | 102 | 0.02 |
| 4 | Invention | S-1 | 0 | −0.06 | −6.1 | 105 | 0.12 |
| 5 | Invention | S-10 | 0 | −0.05 | −5.4 | 107 | 0.10 |
| 6 | Invention | S-11 | 0 | −0.03 | −4.6 | 105 | 0.10 |
| 7 | Invention | S-13 | 0 | −0.04 | −5.5 | 105 | 0.09 |
| 8 | Invention | S-14 | 0 | −0.04 | −4.6 | 107 | 0.06 |
| 9 | Invention | S-6 | 0 | −0.04 | −5.0 | 107 | 0.06 |
| 10 | Invention | S-7 | 0 | −0.06 | −5.2 | 105 | 0.09 |
| 11 | Invention | S-8 | 0 | −0.04 | −4.9 | 107 | 0.10 |
| 12 | Invention | S-9 | 0 | −0.03 | −4.1 | 102 | 0 02 |
| 13 | Invention | S-5 | 0 | −0.04 | −4.9 | 107 | 0.10 |
| 14 | Invention | S-4 | 0 | −0.05 | −5.4 | 107 | 0.06 |
| 15 | Invention | S-3 | 0 | −0.04 | −5.7 | 102 | 0.05 |
| 16 | Invention | S-2 | 0 | −0.05 | −5.0 | 107 | 0.15 |

Example 13

Film-coating evaluations were carried out in a color format on a sulfur-and-gold sensitized 2.44×0.127 um silver bromide tabular emulsion containing 3.7 mole % iodide. The emulsion was heated to 43.3C and sodium thiocyanate (100 mg/Ag mole) was added. After a 5' hold, 3-(2-methylsulfamoylethyl)-benzothiazolium tetrafluoroborate (25 mg/Ag mole) was added followed by a 2' hold. The first red anionic sensitizing dye (RSD-1, 0.038 mM/Ag mole) was then added. After a 5' hold, the second red anionic sensitizing dye (RSD-2, 0.102 mM/Ag mole) was added followed by a 15' hold. A third red anionic sensitizing dye (RSD-3, 0.634 mM/Ag mole) was then added followed by a 20' hold. This was followed by the addition of sodium aurous dithiosulfate dihydrate (2.193 mg/Ag mole). After a 2' hold, sodium thiosulfate pentahydrate (1.035 mg/Ag mole) was added followed by a 2' hold. The emulsion was then heated to 59.4C and held for 15'. After cooling to 40C, 4-hydroxy-6-methyl-1,3,3a,7-tetraazaindene, sodium salt, monohydrate (0.75 g/Ag mole) was added followed by a 2' hold. Next, 1-(3-acetamidophenyl)-5-mercaptotetrazole (17.2 mg/Ag mole) was added followed by a 2' hold. Subsequently, the red cationic antenna dye (RSD-4, 1.30 mM/Ag mole) was added followed by a 30' hold ("Reference"). Next, S-1 surfactant (sodium di-2-ethylhexyl-sulfosuccinate) and sodium 2,5-dihydroxy-4-(1-methylheptadecyl)-benzenesulfonate (DOX-3) were added sequentially each with a 5' hold ("Invention"). Finally, gelatin and water were added to the emulsion melts at a concentration of 0.216 Ag mole/kg for coating. Single-layer coatings were made on acetate support. Silver laydown was 1076 mg/m2 (100 mg/ft2). The silver melt was combined with a coupler dispersion containing a cyan-forming coupler CC-1 at a laydown of 323 mg/m2 (30 mg/ft2). The gelatin laydown was 3229 mg/m2 (300 mg/ft2). A hardened gelatin overcoat was then applied with a laydown of 2691 mg/m2 (250 mg/ft2). Sensitometric exposures (0.01 sec) were carried out using tungsten illumination with filtration to simulate a daylight exposure. The described elements were processed for 3.25' in the known C-41 color process. Dye-layered emulsion with S-1, plus DOX-3 (added at various levels and ratios), exhibits (relative to dye-layered emulsion without): (a) lower Dmin, (b) lower Dmin-granularity, and (c) higher speed and contrast. In general, significant improvements in sensitometric performance (D-min, Dmin-granularity, contrast, speed) may be realized with S-1+ DOX-3 added at combined levels of 2.25 gms/AgM, or less.

| Sample | | S-1 | DOX-3 | ΔDmin | Rel. Granularity @ Dmin | Normalized Relative Sensitivity @ 0.15 D | ΔGamma |
|---|---|---|---|---|---|---|---|
| 1 | Reference | 0 | 0 | Ref (0) | Ref (0) | Ref (100) | Ref (0) |
| 2 | Invention | 1.50 | 0.50 | −0.12 | −8.8 | 112 | 0.16 |
| 3 | Invention | 1.50 | 0.75 | −0.12 | −9.0 | 110 | 0.17 |
| 4 | Invention | 1.25 | 0.75 | −0.11 | −8.5 | 110 | 0.14 |
| 5 | Invention | 1.25 | 0.50 | −0.11 | −7.8 | 115 | 0.14 |
| 6 | Invention | 1.00 | 0.75 | −0.10 | −7.2 | 115 | 0.15 |
| 7 | Invention | 1.00 | 0.50 | −0.10 | −6.8 | 115 | 0.15 |

The invention has been described in detail with particular reference to certain preferred embodiments thereof, but it will be understood that variations and modifications can be effected within the spirit and scope of the invention.

What is claimed is:

1. A method of spectrally sensitizing a silver halide emulsion comprising the following steps in the following order a) providing a silver halide emulsion comprising tabular silver halide grains having an inner dye layer adjacent to the silver halide grain, said dye layer comprising at least one dye (Dye 1) that is capable of spectrally sensitizing silver halide, b) adding to the emulsion at least one dye (Dye 2) capable of providing a second dye layer adjacent to the inner dye layer, and c) adding to the emulsion a scavenger for oxidized developer, to form a silver halide emulsion comprising silver halide grains having associated therewith two dye layers, wherein the dye layers are held together by non-covalent forces or by in situ bond formation; the outer dye layer adsorbs light at equal or higher energy than the inner dye layer; and the energy emission wavelength of the outer dye layer overlaps with the energy absorption wavelength of the inner dye layer.

2. The method of claim 1 wherein Dye 1 comprises at least one anionic substituent, and Dye 2 comprises at least one cationic substituent.

3. The method of claim 1 wherein Dye 1 is a cyanine dye and Dye 2 is not a cyanine dye.

4. The method of claim 2 wherein Dye 1 is a cyanine dye and Dye 2 is not a cyanine dye.

5. The method of claim 1 further comprising adding chemical sensitizers and heating the emulsion between steps a) and b).

6. The method of claim 1 wherein the scavenger for oxidized developer is added at a concentration of less than 5 mmoles per silver mole.

7. The method of claim 1 wherein the scavenger for oxidized developer is a hydroquinone.

8. The method of claim 7 wherein the hydroquinone scavenger contains an anionic water-solubilizing group.

9. The method of claim 8 wherein the solubilizing group is a sulfo group.

10. The method of claim 1 wherein the scavenger for oxidized developer is introduced as a dispersion in a permanent oil solvent.

11. The method of claim 7 wherein the hydroquinone scavenger is represented by Formula (I):

(Formula I)

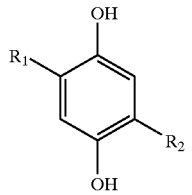

where $R_1$ and $R_2$ are independently hydrogen or alkyl, aryl, alkyloxy or, amino groups, sulfonic acid (including its salts) or carboxylic acid (including its salts), with the proviso that $R_1$ and $R_2$ cannot both be hydrogen and that the sum total of carbon atoms between $R_1$ and $R_2$ is at least 8.

12. The method of claim 11 wherein one of $R_1$ or $R_2$ is a sulfonic acid (including its salts) or carboxylic acid (including its salts).

13. The method of claim 12 wherein the hydroquinone scavenger is added at a concentration in the range of $10^{-1}$ times its CAC value and 50% of (CMC2−CAC), wherein CMC2 is the point at which the surfactant forms non-gelatin-bound micelles in solution, with the proviso that the scavenger is added at a concentration of less than 5 mmoles per silver mole.

14. The method of claim 11 wherein if $R_1$ or $R_2$ is alkyl, the alkyl group is branched at the position next to the hydroquinone ring.

15. The method of claim 11 wherein $R_1$ or $R_2$ is independently substituted with a water-solubilizing group.

16. The method of claim 1 wherein the scavenger for oxidized developer is a hydrazide scavenger represented by Formula II:

(Formula II)

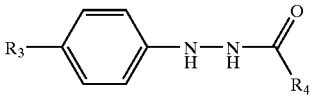

where $R_3$ is an electron-donation group and $R_4$ is an alkyl, aryl, amino, thio or oxy group.

17. The method of claim 16 wherein the sum total of carbon atoms between $R_3$ and $R_4$ is at least 8.

18. The method of claim 16 wherein the hydrazide scavenger contains a water-solubilizing group.

19. The method of claim 17 wherein the hydrazide scavenger contains a water-solubilizing group.

20. The method of claim 16 wherein $R_3$ is an amino or oxy and $R_4$ is an alkyl or aryl group.

21. The method of claim 1 further comprising adding a surfactant during step c).

22. The method of claim 21 wherein the surfactant is anionic.

23. The method of claim 21 wherein the surfactant is a non-redox reactive surfactant.

24. The method of claim 22 wherein the surfactant possesses a critical aggregation concentration (CAC) in aqueous gelatin in the range $10^{-2}$ to $10^{-6}$ moles/kg (molal) at 40° C.

25. The method of claim 22 wherein the surfactant is added at a concentration in the range of $10^{-1}$ times its CAC value and 70% of (CMC2−CAC)), wherein CMC2 is the point at which the surfactant forms non-gelatin-bound micelles in solution.

26. The method of claim 22 wherein the surfactant is added at a concentration in the range of $10^{-1}$ times its CAC value and 50% of (CMC2−CAC)), wherein CMC2 is the point at which the surfactant forms non-gelatin-hound micelles in solution.

27. The method of claim 22 wherein the surfactant is added at a concentration in the range of $10^{-1}$ times its CAC value and 30% of (CMC2−CAC)), wherein CMC2 is the point at which the surfactant forms non-gelatin-bound micelles in solution.

28. The method of claim 22 wherein the surfactant contains two or three hydrophobic tail groups.

29. The method of claim 22 wherein the surfactant is a sulfosuccinate ester.

30. The method of claim 29 wherein the surfactant is di-(2-ethylhexyl) sulphosuccinate sodium salt.

31. The method of claim 22 wherein the surfactant is a sulphotricarballylate.

* * * * *